US009162494B2

(12) United States Patent
Harano

(10) Patent No.: US 9,162,494 B2
(45) Date of Patent: Oct. 20, 2015

(54) PRINTING APPARATUS FOR CONTROLLING SHEET FEEDING FROM A GROUPED PLURALITY OF SHEET FEEDING UNITS

(71) Applicant: CANON KABUSHIKI KAISHA, Tokyo (JP)

(72) Inventor: Yuzo Harano, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/083,313

(22) Filed: Nov. 18, 2013

(65) Prior Publication Data

US 2014/0140749 A1 May 22, 2014

(30) Foreign Application Priority Data

Nov. 21, 2012 (JP) ..... 2012-255153

(51) Int. Cl.

| | |
|---|---|
| ***B41J 13/00*** | (2006.01) |
| ***B65H 3/44*** | (2006.01) |
| ***B41J 29/38*** | (2006.01) |
| ***B41J 11/48*** | (2006.01) |
| ***G03G 15/00*** | (2006.01) |
| ***B41J 11/00*** | (2006.01) |

(52) U.S. Cl.

CPC ..... *B41J 11/485* (2013.01); *B41J 11/0075* (2013.01); *B41J 13/0009* (2013.01); *B65H 3/446* (2013.01); *G03G 15/6508* (2013.01)

(58) Field of Classification Search

CPC ... B65H 3/446; B41J 11/485; G05G 15/6568; G03G 15/6508

See application file for complete search history.

(56) References Cited

U.S. PATENT DOCUMENTS

| | | | | | |
|---|---|---|---|---|---|
| 5,168,316 | A | * | 12/1992 | Hino et al. | 399/23 |
| 6,125,242 | A | * | 9/2000 | Yamada | 399/23 |
| 2013/0077109 | A1 | * | 3/2013 | Wakana | 358/1.12 |

FOREIGN PATENT DOCUMENTS

| | | | | | |
|---|---|---|---|---|---|
| JP | 2006185377 | A | * | 7/2006 | B41J 29/38 |
| JP | 2009-256076 | A | | 11/2009 | |
| JP | 2010100375 | A | * | 5/2010 | B65H 3/44 |
| JP | 2011186405 | A | * | 9/2011 | G03G 21/00 |

* cited by examiner

*Primary Examiner* — Daniel J Colilla

(74) *Attorney, Agent, or Firm* — Canon USA, Inc. IP Division

(57) ABSTRACT

A printing system includes a receiving unit, a printing unit, a grouping unit, a determining unit, and a control unit. The receiving unit receives a job in which a sheet feeding source is designated. The printing unit prints an image on a sheet fed from one of a plurality of sheet storage units. The grouping unit groups some of the sheet storage units as one virtual sheet storage unit. The determining unit determines which of one of the sheet storage units or the virtual sheet storage unit is the sheet feeding source. The control unit controls sheet feeding to continue the printing. When the sheet feeding source is determined to be a sheet storage unit, a sheet is fed from the designated sheet storage unit. When the sheet feeding source is determined to be the virtual sheet storage unit, sheets are respectively fed from the grouped sheet storage units.

15 Claims, 15 Drawing Sheets

SHEET STORAGE UNIT SETTING SCREEN

VIRTUAL SHEET STORAGE UNIT SETTING SCREEN

SHEET STORAGE UNIT SETTING SCREEN

VIRTUAL SHEET STORAGE UNIT SETTING SCREEN

SHEET STORAGE UNIT SETTING SCREEN

VIRTUAL SHEET STORAGE UNIT SETTING SCREEN

PRINTING APPARATUS FOR CONTROLLING SHEET FEEDING FROM A GROUPED PLURALITY OF SHEET FEEDING UNITS

BACKGROUND OF THE INVENTION

1. Field of the Invention

The present invention relates to a printing system, a method for controlling the printing system, and a storage medium.

2. Description of the Related Art

There has conventionally been offered a printing apparatus that includes a plurality of sheet storage units such as a sheet storage cassette, a sheet storage deck, or a manual feed tray for storing sheets. There is known a technique for grouping the plurality of sheet storage units for each sheet size or type, and continuing, even when paper running-out or the like occurs in a designated sheet storage unit, printing by switching to another sheet storage unit in the group to which the designated sheet storage unit belongs (as discussed in Japanese Patent Application Laid-Open No. 2009-256076). This is a technique for improving productivity of print products in the printing apparatus, and suited to the need of performing a great volume of print jobs by preventing sheet running-out as much as possible.

There is similarly a need original to sheet storage unit designation to perform printing by always feeding sheets only from a designated sheet storage unit. Also in this case, the method for designating the sheet storage unit at the time of starting printing is used. However, if the designated sheet storage unit is grouped with the other sheet storage units, there is a possibility that a sheet will be fed from an undesignated sheet storage unit, thus disabling an expected operation to be obtained. Thus, the conventional technique cannot be used.

The print job is a job to be performed by designating sheet storage unit. Thus, control of grouping should not be performed for such a print job. Further, in a printing environment having such two types of needs, various printing apparatuses are generally present, and thus customization unique to a printing apparatus is not suited. A print job is generated by a more general-purpose standard method, such as a standard page description language (PDL) command for designating a sheet storage unit.

In other words, control must be performed to simultaneously satisfy both needs not by a PDL command uniquely extended by the printing apparatus but within the standard PDL command.

SUMMARY OF THE INVENTION

Sheet feeding processing can be switched according to requests of print processing using grouped sheet storage units and print processing using a designated sheet storage unit. According to an aspect of the present invention, a printing system includes a receiving unit configured to receive a job in which a sheet feeding source is designated, a printing unit configured to print an image on a sheet fed from one of a plurality of sheet storage units, a grouping unit configured to group some of the plurality of sheet storage units as one virtual sheet storage unit, a determining unit configured to determine, as a designated sheet storage unit, which of one of the plurality of sheet storage units or the virtual sheet storage unit is the sheet feeding source designated by the received job, and a control unit configured to control sheet feeding, wherein, when the sheet feeding source designated by the job is determined to be one of the plurality of sheet storage units, the control unit controls sheet feeding so that a sheet is fed from the designated sheet storage unit to continue the printing by the printing unit and wherein, when the sheet feeding source designated by the job is determined to be the virtual sheet storage unit, the control unit controls sheet feeding so that sheets are respectively fed from the grouped sheet storage units to continue the printing by the printing unit.

Further features of the present invention will become apparent from the following detailed description of exemplary embodiments with reference to the attached drawings.

DESCRIPTION OF THE EMBODIMENTS

Various exemplary embodiments, features, and aspects of the invention will be described in detail below with reference to the drawings.

<System Configuration>

Figure 1:
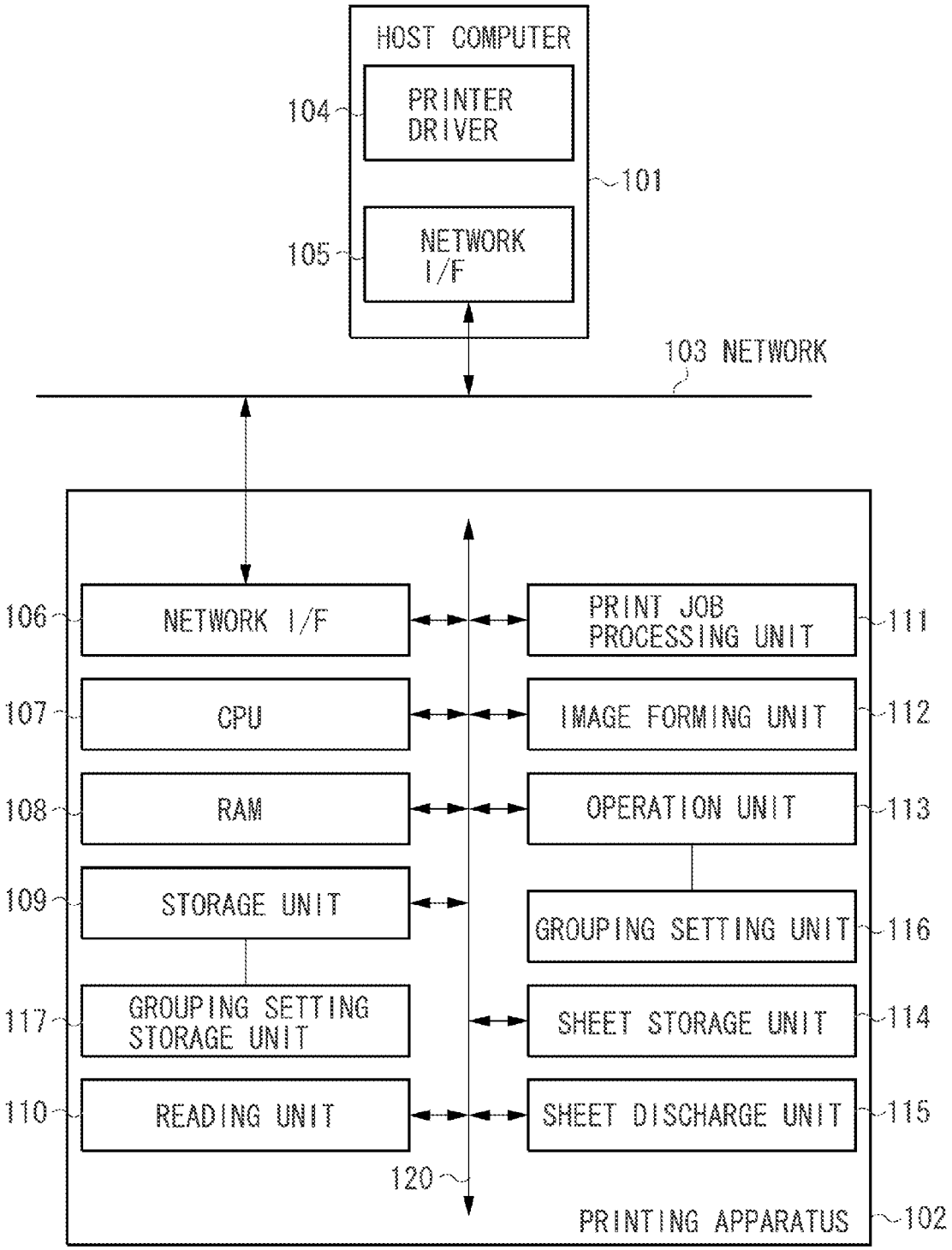
FIG. 1 is a block diagram illustrating an entire printing system including a printing apparatus.

FIG. 1 is a block diagram illustrating an entire printing system including a printing apparatus according to the present exemplary embodiment. As long as functions such as print processing according to the present exemplary embodiment can be executed, the printing system may be a system including a single device or a plurality of devices. Alternatively, the printing system may be a system connected via a network such as a local area network (LAN) or a wide area network (WAN). In other words, a system configuration where various terminals are connected according to the exemplary embodiments described below is only an example. A variety of configurations can be employed according to uses and purposes.

The printing system illustrated in FIG. 1 includes a host computer 101, a printing apparatus 102, and a network 103.

The host computer 101 is an apparatus in which a printer driver 104 is installed and connected to the network 103 via a network interface (I/F) 105.

In the present exemplary embodiment, the host computer 101 will be described as a personal computer (PC). A printer driver 104 is software operated on an operating system (OS) for controlling the host computer 101. The printer driver 104 represents print data in PDL in response to a printing instruction from an application to transmit it as a print job to the printing apparatus 102. The network I/F 105, which is configured to connect to and communicate with an external device via the network 103, performs communication control processing on network.

For example, the network I/F 105 can perform Internet communication using a transmission control protocol/Internet protocol (TCP/IP) method or transfer data with the printing apparatus 102.

The PC generally includes various input-output devices such as a central processing unit (CPU), a hard disk drive (HDD), and a random access memory (RAM). These are general-purpose units, and thus description thereof will be omitted in the present exemplary embodiment.

The printing apparatus 102 includes a network I/F 106, a CPU 107, a RAM 108, a nonvolatile storage unit 109, a reading unit 110, a print job processing unit 111, an image forming unit 112, an operation unit 113, a sheet storage unit 114, and a sheet discharge unit 115. These units are connected via a system bus 120.

The operation unit 113 includes a grouping setting unit 116 as its subsystem, and the storage unit 109 includes a grouping setting storage unit 117 as its subsystem. In the present exemplary embodiment, the printing apparatus 102 will be described as a multifunction peripheral (MFP) including copying, printing, and facsimile (FAX) functions.

The network I/F 106, which is configured to connect to and communicate with the external device via the network 103, performs communication control processing on network. For example, the network I/F 106 can perform Internet communication using the TCP/IP method or transfer data with the host computer 101.

The CPU 107 performs various arithmetic operations, information processing, and device control by various programs stored in the storage unit 109 of the printing apparatus 102 and loaded to the RAM 108. The RAM 108 is a type of a general volatile storage device directly accessible from the CPU 107, and used as a work area of the CPU 107 and for temporary data storage.

The storage unit 109 plays a role of temporarily or permanently storing print jobs received from the host computer 101, and will be described as a HDD in the present exemplary embodiment. The reading unit 110, which optically reads a paper document, will be described as a scanner in the present exemplary embodiment. The scanner, which includes a document illumination lamp and a scanning mirror, optically scans a document placed on a document positioning glass. Reflected light from the document is guided to a lens by the scanning mirror and a reflection mirror, and an optical signal passed through the lens is guided to a solid-state image sensor. The optical signal is converted into an electric signal by the solid-state image sensor to be recognized as an image signal.

The solid-state image sensor is, for example, an image sensor of a charge coupled device (CCD) type or a complementary metal oxide semiconductor (CMOS) type.

The print processing unit 111 generates print image data by processing print job such as a copy, PDL, or FAX to transfer it to the image forming unit 112 to be described below. The PDL is a language represented by a post script (PS) or a printer control language (PCL) for describing a command to control a page printer. The print processing unit 111, which has received the print job, subjects the print job to image processing according to its print attribute, and converts the result into raster data for each page to create print image data.

The image forming unit 112 configured to print the raster data that is the print image data transmitted from the print job processing unit 111 will be described as a printer engine in the present exemplary embodiment. The image forming unit 112 converts the raster data generated by a raster image processor (RIP) processing of the print job processing unit 111 into a print product by forming an image on a printing sheet.

In the present exemplary embodiment, toner is used by an electrophotographic method for image formation. However, other methods, such as ink in place of toner, can be used.

The operation unit 113, which is a user interface for performing an operation or setting of the printing apparatus, will be described as a device using a liquid crystal display (LCD) touch panel. The sheet storage unit 114 configured to store printing sheets used in the MFP is referred to as a cassette or a deck, and generally the MFP includes a plurality of these units Therefore, the sheet storage unit 114 is sometimes referred to as sheet storage units 114.

Which of the plurality of sheet storage units a printing sheet is fed from varies depending on a sheet attribute of the print job, setting, or a state of the MFP, and determined by the print job processing unit 111. The fed printing sheet is finally converted into a print product by the image forming unit 112.

The sheet discharge unit 115, which is configured to discharge the print product generated by the image forming unit 1112 to the outside of the printing apparatus 102, will be described as a finisher in the present exemplary embodiment. Generally, the sheet discharge unit 115 represented by a finisher or a stacker has some sheet discharge destinations such as sheet discharge trays. A sheet discharge destination is determined by the print job processing unit 111 according to the attribute of the print job, an instruction is issued therefrom, and sheet discharge control is performed.

The grouping setting unit 116, which is a subsystem of the operation unit 113, divides the plurality of sheet storage units 114 into groups (grouping). The grouping setting unit 116 adds information different from information predefined in the sheet storage unit 114 and specifying the sheet storage to each group, and performs setting to virtually generate a new sheet storage unit 114 through the operation unit 113.

The information (specific sheet storage information) specifying the new virtual sheet storage unit 114 is a unique number added to each sheet storage unit 114 or a unique name similarly added to each sheet storage unit 114. There is no limitation on a type of the information. The grouping setting storage unit 117, which is a subsystem of the storage unit 109, stores a setting value regarding the grouping of the sheet storage units 114 in the grouping setting unit 116.

The network 103, which is a global or local network represented by the Internet or a LAN, is a medium for connecting the printing apparatus 102 and the host computer 101. For the connection, a network communication technology represented by the TCP/IP method is used.

Lastly, the print job processing unit 111 in the present exemplary embodiment will be described in more detail. The print job processing unit 111, which has received the print job from the host computer 101, determines whether the print job includes sheet storage unit designation designating use of specific one of the plurality of sheet storage units 114. When the sheet storage designation is included, and the designated sheet storage unit 114 is a virtual sheet storage unit 114 generated by the grouping setting unit 116, the print job processing unit 111 obtains grouping setting information as sheet storage unit information from the grouping setting storage unit 117. The print job processing unit 111 feeds a printing sheet according to the sheet storage unit information set by the grouping setting unit 116 to control print processing.

Figure 2:
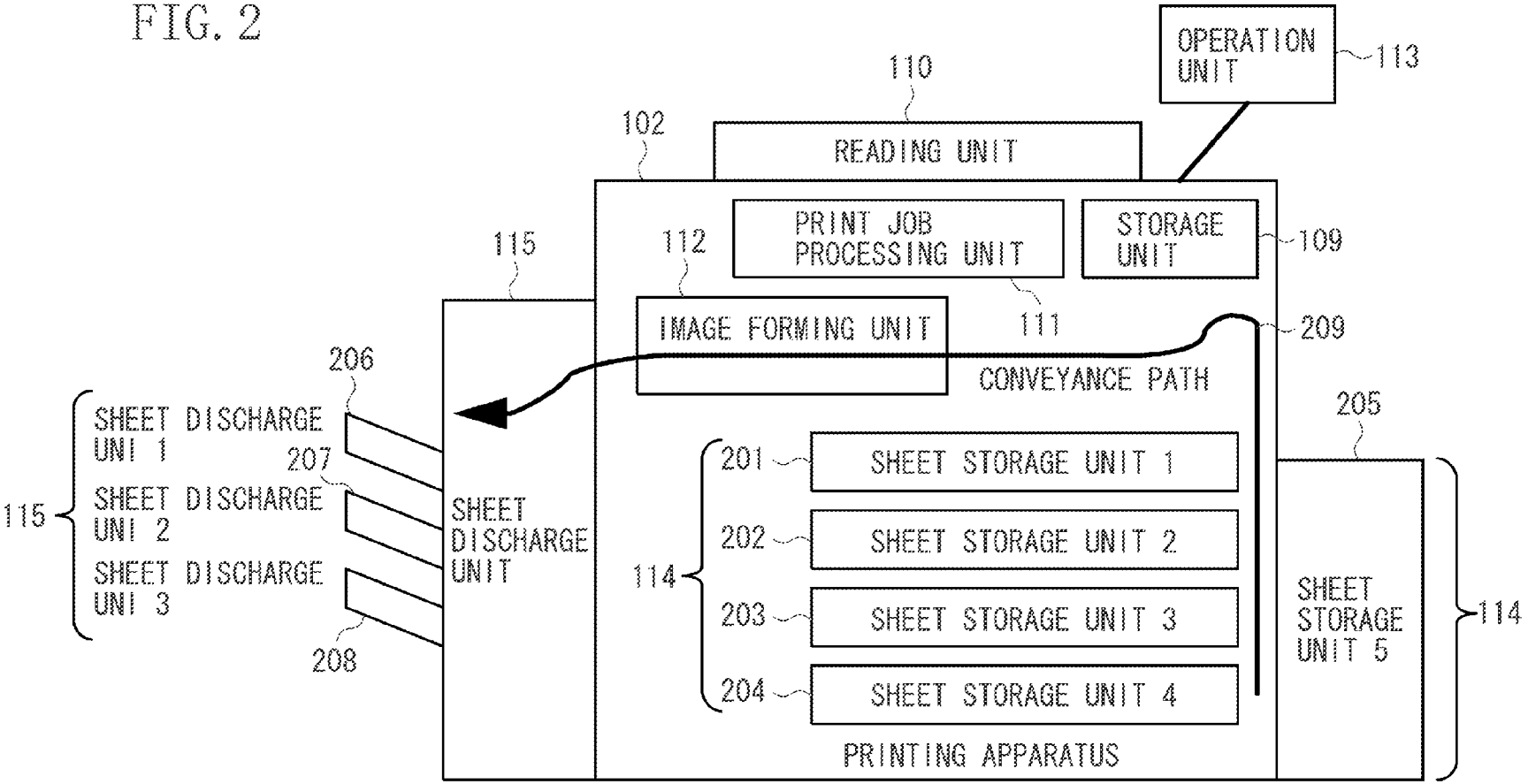
FIG. 2 is a diagram illustrating a configuration of the printing apparatus illustrated in FIG. 1.

FIG. 2 is a diagram illustrating a configuration of the printing apparatus 102 illustrated in FIG. 1.

In FIG. 2, the printing apparatus 102 includes, as described above, the storage unit 109, the reading unit 110, the print job processing unit 111, the image forming unit 112, the operation unit 113, the plurality of sheet storage units 114, and the plurality of sheet discharge units 115. The sheet storage unit 114 includes a plurality of sheet cassettes, i.e., a sheet storage unit 201, a sheet storage unit 202, a sheet storage unit 203, and a sheet storage unit 204, and a sheet deck, i.e., a sheet storage unit 205. The sheet discharge unit 115 includes a plurality of sheet discharge trays, i.e., a sheet discharge unit 206, a sheet discharge unit 207, and a sheet discharge unit 208. Elements unnecessary for description of FIG. 2 are omitted.

A paper conveyance path 209 is a conveyance path of a printing sheet from feeding, after a start of printing control at the print job processing unit 111, of the sheet from one of the sheet storage units 201 to 205 through the image forming unit 112 to reaching the sheet discharge unit 115.

In the present exemplary embodiment, the printing sheet generated at the image forming unit 112 is discharged to one fixed position of the sheet discharge unit 115. Thus, the sheet discharge units 206 to 208 must vertically move to a predetermined sheet discharge position according to a sheet discharge destination attribute of the print job.

Figure 3:
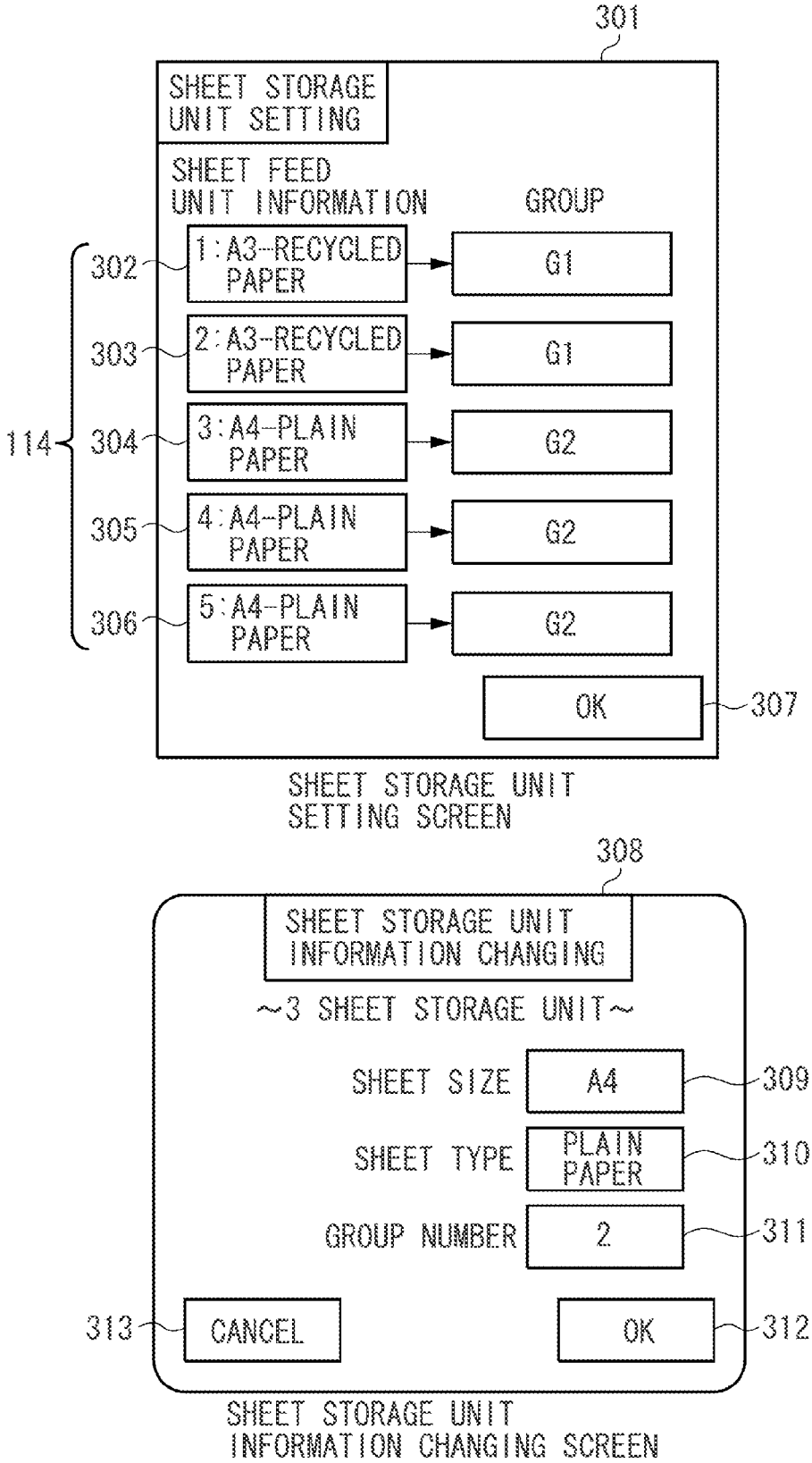
FIG. 3 is an explanatory diagram illustrating a sheet storage unit setting screen for performing grouping setting and checking of sheet storage units.

FIG. 3 is an explanatory diagram illustrating a sheet storage unit setting screen for performing grouping setting and checking of sheet storage units included in the printing apparatus. FIG. 3 illustrates a sheet storage unit setting screen example for performing grouping setting and checking of sheet storage units according to a conventional technology for comparison with the present invention.

In FIG. 3, a sheet storage unit setting screen 301 for performing grouping setting and checking of a plurality of sheet storage units 114 is displayed by a grouping setting unit 116 using a graphical user interface (GUI) via an operation unit 113 of a printing apparatus 102. FIG. 3 illustrates, as an example, a state where the plurality of sheet storage units 114 has been subjected to grouping setting.

There are totally five sheet storage units 114. According to sheet storage unit information, a sheet storage unit 302 stores printing sheets of a sheet size "A3" and a sheet type "recycled paper", and a sheet storage unit group number is set to "1". Similarly, a sheet storage unit 303 stores printing sheets of a sheet size "A3" and a sheet type "recycled paper", and a sheet storage unit group number is set to "1 (G1)".

A sheet storage unit 304 stores printing sheets of a sheet size "A4" and a sheet type "plain paper", and a sheet storage unit group number is set to "2 (G2)". Similarly, a sheet storage unit 305 stores printing sheets of a sheet size "A4" and a sheet type "plain paper", and a sheet storage unit group number is set to "2". Similarly, a sheet storage unit 306 stores printing sheets of a sheet size "A4" and a sheet type "plain paper", and a sheet storage unit group number is set to "2".

After GUIs indicating the sheet storage units 302 to 306 have been selected on the sheet storage unit setting screen 301 via a touch panel of the operation unit 113, the grouping setting unit 116 displays a sheet storage unit information changing screen 308 for changing sheet storage unit information thereof. FIG. 3 illustrates, as an example, sheet storage unit information of the sheet storage unit 304, indicating a state where changing is permitted.

The sheet storage unit information includes a sheet size 309, a sheet type 310, and a group number 311. As described above, the printing sheet of a sheet size 309 "A4" and a sheet type 310 "plain paper" is currently stored, and a group number 311 is set to "2". To change the sheet size 309, a sheet size storable in the sheet storage unit 304 of the printing apparatus 102, such as "A4", "A3", "letter", or "ledger", can be set on the screen.

For selection of a sheet size, a list of sheet size candidates can be displayed by selecting the GUI of the display unit of the sheet size 309, or the candidates can be displayed on a pop-up screen of another screen. Any method can be used as long as sheet sizes can be displayed and selected.

To change the sheet type 310, a sheet type storable in the sheet storage unit 304 of the printing apparatus 102, such as "plain paper", "thick paper", "coated paper", or "recycled paper", can be set on the screen. For selection of a sheet type, a list of sheet type candidates can be displayed by selecting the GUI of the display unit of the sheet size type 310, or the candidates can be displayed on a pop-up screen of another screen. Any method can be used as long as sheet types can be displayed and selected.

To change the group number 311, an arbitrary number can be set on the screen. When a group number set on the screen matches those of other sheet storage units, these sheet storage units are subjected to grouping (grouped) to be targeted for sheet storage unit switching control in the group. For selection of a group number, a list of group number candidates can be displayed by selecting the GUI of the display unit of the group number 311, or the candidates can be displayed on a pop-up screen of another screen. Any method can be used as long as sheet types can be displayed and selected.

To store the sheet size 309, the sheet type 310, the group number 311, and sheet storage unit information thereof and return, an OK button 312 is selected. Then, the grouping setting unit 116 stores a setting value in a grouping setting storage unit 117 to return to the sheet storage unit setting screen 301.

On the other hand, to return without storing the sheet storage unit information, a cancel button 313 is selected. Then, the grouping setting unit 116 returns to the sheet storage unit setting screen 301 without storing any setting value in the grouping setting storage unit 117.

To end the sheet storage unit setting screen 301, the grouping setting unit 116 ends the sheet storage unit setting by selecting an OK button 307.

Figure 4:
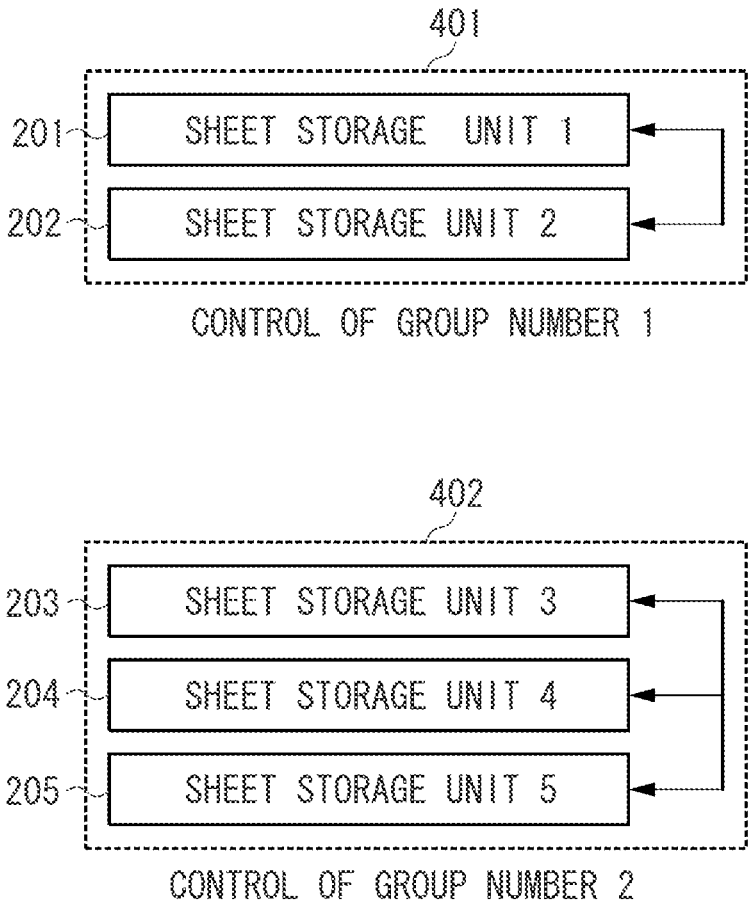
FIG. 4 is an explanatory diagram illustrating grouping control including a plurality of sheet storage units.

FIG. 4 is an explanatory diagram illustrating grouping control including the plurality of sheet storage units in the printing apparatus. FIG. 4 illustrates a grouping control example including the plurality of sheet storage units according to the conventional technique for comparison with the present invention.

In FIG. 4, the sheet storage unit 201 and the sheet storage unit 202 are grouped with a group number 1. As indicated by control 401 of the group number 1, when sheet running-out occurs in any one of the sheet storage units 201 and 202, the sheet storage unit is automatically switched to the other sheet storage unit in the group to which it belongs to continue printing. Specifically, even in a case of a print job designating the sheet storage unit 201, when sheet running-out occurs in the sheet storage unit 201, a print job processing unit 111 switches the sheet storage unit to the sheet storage unit 202 to continue the printing. On the other hand, even in a case of a print job designating the sheet storage unit 202, when sheet running-out occurs in the sheet storage unit 202, the print job processing unit 111 automatically switches the sheet storage unit to the sheet storage unit 201 to continue the printing.

In FIG. 4, the sheet storage unit 203, the sheet storage unit 204, and the sheet storage unit 205 are grouped with a group number 2. As indicated by control 402 of the group number 2, when sheet running-out occurs in any one of the sheet storage units 203, 204, and 205, the sheet storage unit is automatically switched to the other sheet storage unit in the group to which it belongs to continue the printing.

Specifically, even in a case of a print job designating the sheet storage unit 203, when sheet running-out occurs in the sheet storage unit 203, the print job processing unit 111 automatically switches the sheet storage unit to the sheet storage unit 204 or 205 to continue the printing. Even in a case of a print job designating the sheet storage unit 204, when sheet running-out occurs in the sheet storage unit 204, the print job processing unit 111 switches the sheet storage unit to the sheet storage unit 203 or 205 to continue the printing. Further, even in a case of a print job designating the sheet storage unit 205, when sheet running-out occurs in the sheet storage unit 205, the print job processing unit 111 switches the sheet storage unit to the sheet storage unit 203 or 204 to continue the printing.

Thus, by grouping a plurality of sheet storage units, a great volume of print jobs is continuously printed by preventing sheet running-out as much as possible, and productivity of print products can be improved at the printing apparatus.

Figure 5:
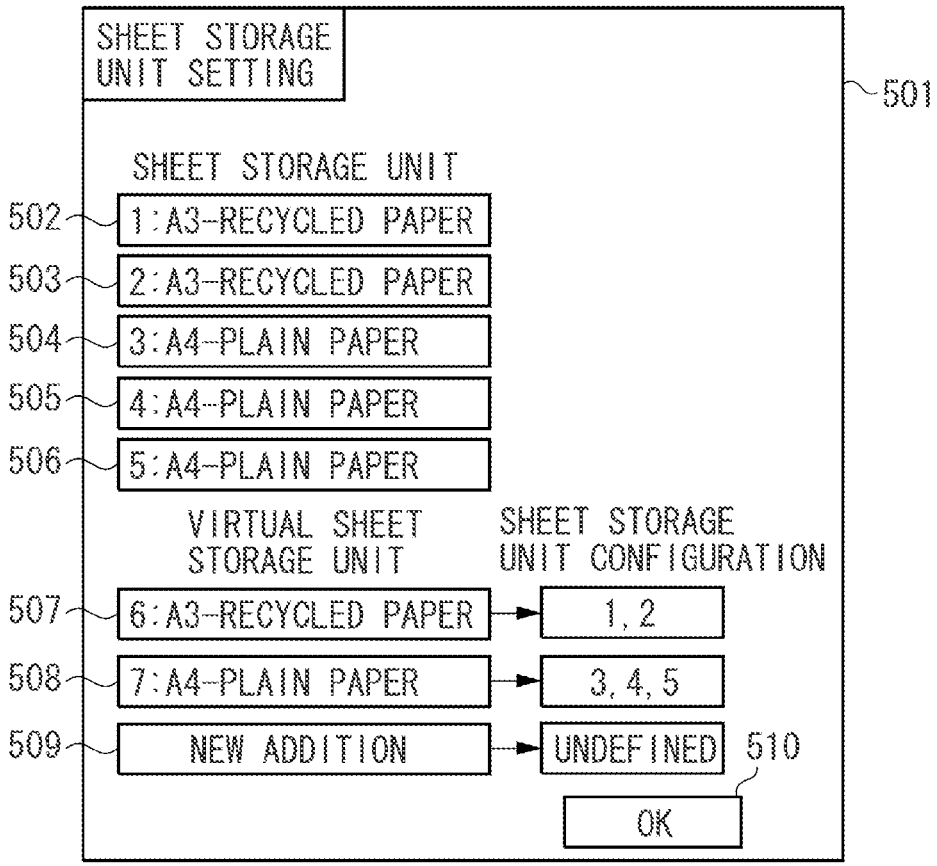
FIG. 5 is an explanatory diagram illustrating a virtual sheet storage unit setting screen for performing grouping setting of sheet storage units and a sheet storage unit setting screen for performing checking thereof.
Figure 5:
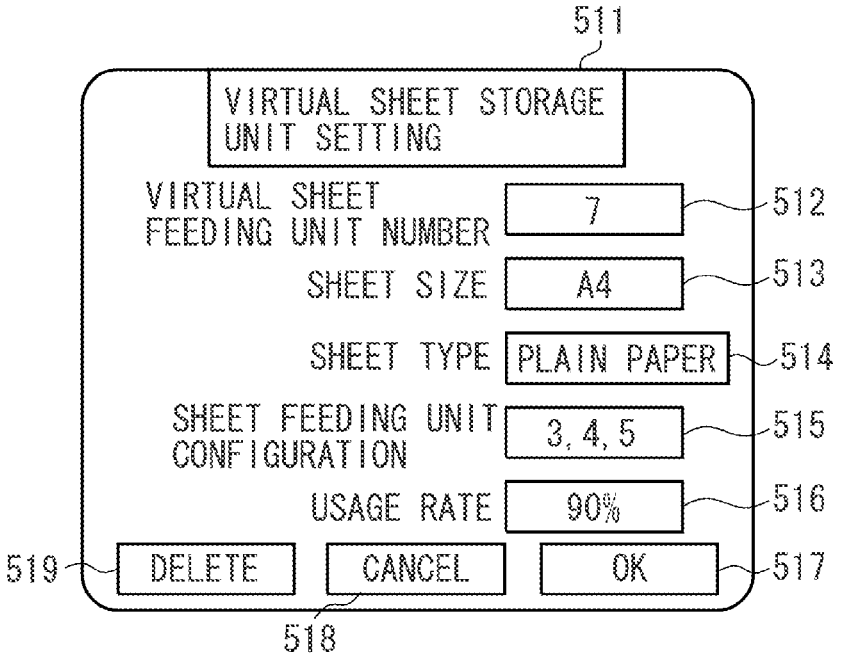

FIG. 5 is an explanatory diagram illustrating a virtual sheet storage unit setting screen for performing grouping setting of the sheet storage units included in the printing apparatus according to the present exemplary embodiment and a sheet storage unit setting screen for performing checking thereof.

In the present exemplary embodiment, concerning the plurality of sheet storage units 114, a sheet storage unit setting screen 501 for performing checking of setting of existing sheet storage units, grouping setting of a virtual sheet storage unit, and checking thereof is displayed by the grouping setting unit 116 using the GUI via the operation unit 113 of the printing apparatus 102. FIG. 5 illustrates, as an example, a state where some grouping setting operations using a plurality of sheet storage units 114 as virtual sheet storage units have been carried out.

There are totally five existing sheet storage units 114. According to the sheet storage unit setting screen 501, a sheet storage unit 502 stores printing sheets of a sheet size "A3" and a sheet type "recycled paper". Similarly, a sheet storage unit 503 stores printing sheets of a sheet size "A3" and a sheet type "recycled paper". A sheet storage unit 504 stores printing sheets of a sheet size "A4" and a sheet type "plain paper". Similarly, a sheet storage unit 505 stores printing sheets of a sheet size "A4" and a sheet type "plain paper". Similarly, a sheet storage unit 506 stores printing sheets of a sheet size "A4" and a sheet type "plain paper".

There are totally two existing sheet storage units 114 registered as virtual sheet storage units. According to the sheet storage unit setting screen 501, a sheet storage unit 507 stores printing sheets of a sheet size "A3" and a sheet type "recycled paper". Sheet storage unit configurations of the sheet storage unit 507, i.e., the grouped existing sheet storage units 114, are the sheet storage unit 502 and the sheet storage unit 503.

Accordingly, to perform sheet feeding control as the sheet storage unit 507, the sheet storage unit 502 and the sheet storage unit 503 are automatically switched to operate. A sheet storage unit 508 stores printing sheets of a sheet size "A4" and a sheet type "plain paper". Sheet storage unit configurations of the sheet storage unit 508, i.e., the grouped existing sheet storage units 114, are the sheet storage units 504 to 506. Accordingly, to perform sheet feeding control as the sheet storage unit 508, the sheet storage units 505 to 506 are automatically switched to operate.

By pressing a new addition button 509 when a new sheet storage unit 114 is defined as a virtual sheet storage unit, a new virtual sheet storage unit can be added on a virtual sheet storage unit setting screen 511 described below.

When the user selects a GUI indicating the sheet storage unit 507 or the sheet storage unit 508 that is a virtual sheet storage unit via the touch panel of the operation unit 113, the grouping setting unit 116 displays the virtual sheet storage unit setting screen 511 for checking virtual sheet storage unit information or changing setting thereof.

By pressing the GUI of the new addition button 509 via the touch panel of the operation unit 113, the user can add a new sheet storage unit 114 that is a virtual sheet storage unit. FIG. 5 illustrates, as an example, sheet storage unit information of the sheet storage unit 508 that is a virtual sheet storage unit, and a changeable state. Needless to say, by pressing the new addition button 509, a new sheet storage unit 114 to which a new virtual sheet storage unit number and an attribute of a virtual sheet storage unit have been added can be added.

In virtual sheet storage unit setting, a virtual sheet feed unit number 512, a sheet size 513, a sheet type 514, a sheet storage unit configuration 515, and a sheet storage unit use rate 516 are present. A printing sheet of a virtual sheet storage unit number 512 of "7", a sheet size 513 of "A4", and a sheet type 514 of "plain paper" including the aforementioned description is currently stored, sheet storage unit configurations 515 are "3" to "5", and a sheet storage unit use rate 516 is 90%. To set or change the virtual sheet storage unit number 512, an arbitrary number is input.

However, a sheet storage unit number added beforehand to the existing sheet storage unit 114 or a virtual sheet storage unit number of the other sheet storage unit 114 defined beforehand as a virtual sheet storage unit cannot be duplicated. For example, numbers other than sheet storage unit numbers 1 to 5 added beforehand to the existing sheet storage units 114 and a virtual sheet storage unit number 6 of the other sheet storage unit 114 defined beforehand as a virtual sheet storage unit, i.e., 7 or larger can be set.

In the present exemplary embodiment, the setting item is the virtual sheet storage unit number. However, not limited to the number, the setting item can be, for example, a name using a character string or another representation as long as it is unique information to identify the sheet storage unit 114.

To set or change the sheet size 513, a sheet size storable in the sheet storage unit 114 of the printing apparatus 102, such as "A4", "A3", "letter", or "ledger", can be set via the screen. For selection of a sheet size, a list of sheet size candidates can be displayed by selecting the GUI of the display unit of the sheet size 513, or the candidates can be displayed on a pop-up screen of another screen. Any method can be used as long as sheet sizes can be displayed and selected.

Exclusive control may be performed with a sheet type set in a sheet type 514 and storable sheet sizes of the existing sheet storage units 114 set in a sheet storage unit configuration 515. To set or change the sheet type 514, a sheet type storable in the sheet storage unit 114 of the printing apparatus 102, such as "plain paper", "thick paper", "coated paper", or "recycled paper", can be set on the screen. For selection of a sheet type, a list of sheet type candidates can be displayed by selecting the GUI of the display unit of the sheet size type 514, or the candidates can be displayed on a pop-up screen of another screen. Any method can be used as long as sheet types can be displayed and selected.

Exclusive control can be performed with a sheet size set in the sheet size 513 and storable sheet sizes of the existing sheet storage units 114 set in the sheet storage unit configuration 515 described below. To set and change the sheet storage unit configuration 515, arbitrary existing sheet storage units 114, i.e., one or more desired sheet storage units 114 are set from the sheet storage units 502 to 506. The set sheet storage units 114 are grouped into one sheet storage unit, and targeted for sheet storage unit switching control in the group. For selection of the sheet storage units 114, a list of candidates of sheet storage units 114 can be displayed by selecting the GUI of the display unit of the sheet storage unit configuration 515.

Alternatively, the candidates can be displayed on a pop-up screen of another screen. Any method can be used as long as the existing sheet storage units 114 can be displayed and selected. Further, exclusive control can be performed with a sheet size set in the sheet size 513 and a sheet type set in the sheet type 514.

To set or change the sheet storage unit use rate 516, an arbitrary use rate is input. When a sheet storing number capacity of each of the existing sheet storage units 114 is 100%, at each sheet storage unit 114, printing sheets are used until the set sheet storage unit use rate is reached, and then sheet storage unit switching control is performed in the group. For example, when a maximum sheet storing number of each existing sheet storage unit to be targeted for the virtual sheet storage unit is 2000, if the sheet storage unit use rate 516 is 90%, 1800 sheets are used from each existing sheet storage unit.

Remaining 10%, i.e., 200 sheets, is left on the sheet storage unit, and the processing is switched to another sheet storage unit in the group. In the present exemplary embodiment, the setting item is the sheet storage unit use rate. However, there is no limitation on use rate as long as a volume of sheets to be used can be set. Other representations such as a real use number may be used. Further, in the present exemplary embodiment, the setting item is the sheet storage unit use rate. On the other hand, a percentage of the number of sheets to be left in each sheet storage unit 114 or a real number can be set as in a case of sheet storage unit remaining amount designation.

To store the virtual sheet storage unit number 512, the sheet size 513, the sheet type 514, the sheet storage unit configuration 515, the sheet storage unit use rate 516, and virtual sheet storage unit setting thereof and return, an OK button 517 is selected. Then, the grouping setting unit 116 stores a setting value in the grouping setting storage unit 117, and returns to the sheet storage unit setting screen 501.

On the other hand, to return without storing the virtual sheet storage unit number 512, the sheet size 513, the sheet type 514, the sheet storage unit configuration 515, the sheet storage unit use rate 516, and virtual sheet storage unit setting thereof, a cancel button 518 is selected. Then, the grouping setting unit 116 returns to the sheet storage unit setting screen 501 without storing any setting value in the grouping setting storage unit 117.

Further, to delete registration of the sheet storage unit 114 itself defined as the virtual sheet storage unit, a delete button 519 is selected. Then, the grouping setting unit 116 deletes the setting value of the sheet storage unit 114 from the grouping setting storage unit 117, and deletes the sheet storage unit 114 itself defined as the virtual sheet storage unit to return to the sheet storage unit setting screen 501.

To end the sheet storage unit setting screen 501, an OK button 510 is selected. Accordingly, the grouping setting unit 116 ends the displaying of the sheet storage unit setting screen 501.

Figure 6:
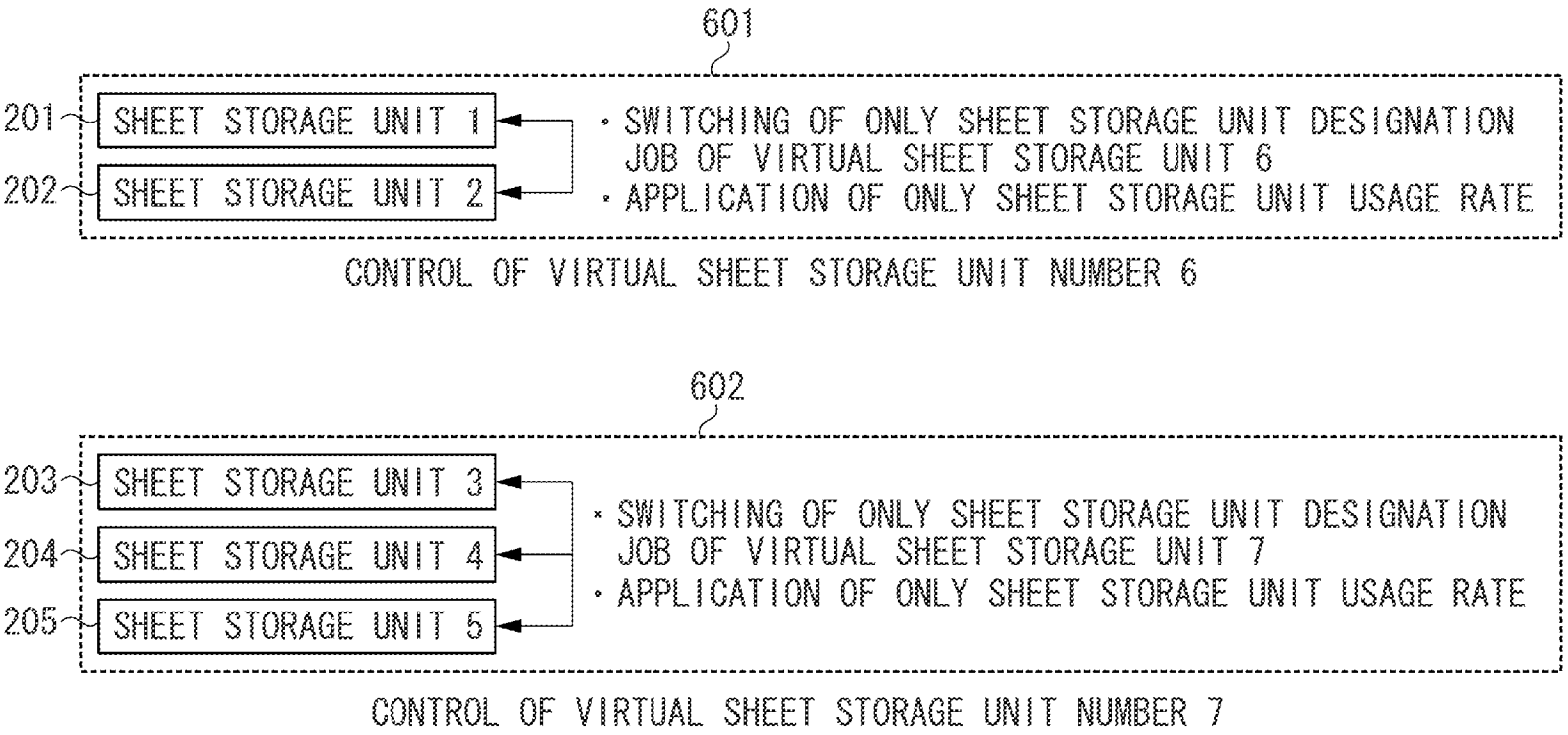
FIG. 6 is an explanatory diagram illustrating grouping control including a plurality of sheet storage units.

FIG. 6 is an explanatory diagram illustrating grouping control including the plurality of sheet storage units included in the printing apparatus according to the present exemplary embodiment.

In the present exemplary embodiment, the sheet storage unit 201 and the sheet storage unit 202 are grouped as a virtual sheet storage unit number 6. As the sheet storage unit use rate 516, for example, 90% is set. As indicated by control 601 of the virtual sheet storage unit number 6, when the virtual sheet storage unit is designated as a print job of sheet storage unit designation, and when a sheet use rate of the sheet storage unit 114 currently feeding sheets has reached 90%, the sheet storage unit is automatically switched to the other sheet storage unit in the group to which it belongs to continue printing. A settable percentage may be limited to a percentage of a sheet use rate (or remaining sheet amount) detectable by a sheet storage unit. The sheet use rate can be determined by dividing, after sheets equal to a maximum sheet stacking amount of the sheet storage unit have been supplied, the number of used sheets by the maximum sheet stacking amount of the sheet storage unit, or detected by a sensor disposed in the sheet storage unit.

Specifically, in a case of a print job designating the sheet storage unit 507, for example, when a sheet use rate of the sheet storage unit 201 has reached 90%, the print job processing unit 111 automatically switches the sheet storage unit to the sheet storage unit 202 to continue the printing. On the other hand, because of control when a virtual sheet storage unit is designated, in a case of a print job designating the existing sheet storage unit such as the sheet storage unit 201 or the sheet storage unit 202, the print job processing unit 111 does not switch the sheet storage unit to continue the printing when sheet running-out occurs.

In FIG. 6, the sheet storage unit 203, the sheet storage unit 204, and the sheet storage unit 205 are grouped as a virtual sheet storage unit number 7. As the sheet storage unit use rate 516, for example, 90% is set. As indicated by control 602 of the virtual sheet storage unit number 7, when the virtual sheet storage unit is designated as a print job of sheet storage unit designation, and when a sheet use rate of the sheet storage unit 114 currently feeding sheets has reached 90%, the sheet storage unit is automatically switched to the other sheet storage unit in the group to which it belongs to continue printing.

Specifically, in a case of a print job designating the sheet storage unit 508, for example, when a sheet use rate of the sheet storage unit 203 has reached 90%, the print job processing unit 111 switches the sheet storage unit to the sheet storage unit 204 to continue the printing. When a sheet use rate of the sheet storage unit 204 has reached 90%, the print job processing unit 111 automatically switches the sheet storage unit to the sheet storage unit 205 to continue the printing.

On the other hand, because of control when a virtual sheet storage unit is designated, in a case of a print job designating the existing sheet storage unit such as the sheet storage units 203 to 205, the print job processing unit 111 does not automatically switch the sheet storage unit to continue the printing when sheet running-out occurs.

Thus, in the case of the print job of sheet storage unit designation, control for always feeding a sheet only from the designated sheet storage unit to perform printing is made valid while printing from an undesignated sheet storage unit is prevented. By continuously printing a great volume of print jobs by preventing sheet running-out as much as possible, productivity of print products can be improved at the printing apparatus.

These can be simultaneously satisfied by using a more general-purpose standard method. Further, by leaving printing sheets in the respective sheet storage units 114, sheet running-out can be made difficult to occur even when the sheet storage unit 114 where sheet running-out easily occurs due to the influence of a use frequency by sheet storage unit switching control in the group of the virtual sheet storage units is used in the print job of sheet storage unit designation.

Figure 7:
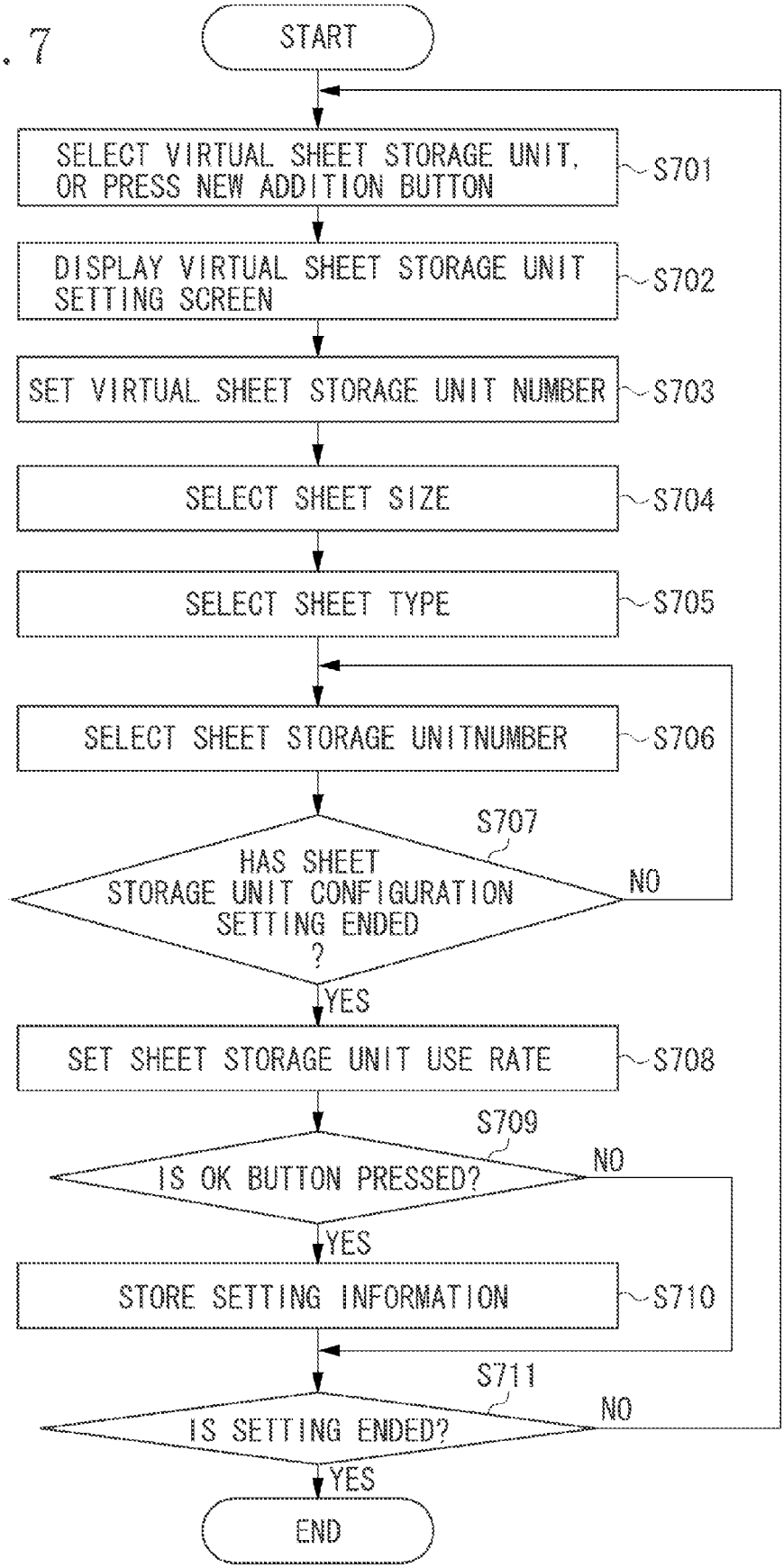
FIG. 7 is a flowchart illustrating a method for controlling the printing system.

FIG. 7 is a flowchart illustrating a method for controlling the printing system according to the present exemplary embodiment. This example is an operation example of sheet storage unit setting. Each step is realized by executing a program stored in the storage unit 109 of the printing apparatus 102 by the grouping setting unit 116.

When the operation unit 113 of the printing apparatus 102 calls up the sheet storage unit setting screen 501, the grouping setting unit 116 starts the operation.

In step S701, the grouping setting unit 116 detects selection of a sheet storage unit 114 that has been defined as a virtual sheet storage unit or pressing of the new addition button 509 from the sheet storage unit setting screen 501.

In step S702, the grouping setting unit 116 displays the sheet storage unit 114 or the virtual sheet storage unit setting screen 511 for new addition.

In step S703, when new setting or changing of the virtual sheet storage unit number 512 is instructed, the grouping setting unit 116 stores a number as unique information to identify the input sheet storage unit 114.

In step S704, when new setting or changing of the sheet size 513 is instructed, the grouping setting unit 116 displays sheet size candidates storable in the sheet storage unit 114 to store a selected sheet size.

In step S705, when new setting or changing of the sheet type 514 is instructed, the grouping setting unit 116 displays sheet type candidates storable in the sheet storage unit 114 to store a selected sheet type therein.

In step S706, when new setting or changing of the sheet storage unit configuration 515 is instructed, the grouping setting unit 116 displays existing sheet storage units 114 that are grouping candidates to store a selected sheet storage unit.

In step S707, the grouping setting unit 116 determines whether sheet storage unit selection of the sheet storage unit configuration 515 has been ended.

When ended (YES in step S707), then in step S708, when new setting or changing of the sheet storage unit use rate 516 is instructed, the grouping setting unit 116 stores a percentage value defining a sheet use amount of each input sheet storage unit 114. On the other hand, when not ended (NO in step S707), to continue the sheet storage unit selection of the sheet storage unit configuration 515, the processing proceeds to step S706.

In step S709, the grouping setting unit 116 waits for end instruction for the virtual sheet storage unit setting screen 511.

When it is determined that the OK button 517 of the virtual sheet storage unit setting screen 511 has been selected (YES in step S709), then in step S710, the grouping setting unit 116 stores each setting value in the grouping setting storage unit 117.

Then, the processing returns to the sheet storage unit setting screen 501. On the other hand, when it is determined that the cancel button 518 of the virtual sheet storage unit setting screen 511 has been selected (NO in step S709), the grouping setting unit 116 returns to the sheet storage unit setting screen 501 without storing any current setting value in the grouping setting storage unit 117.

When it is determined that the delete button 519 of the virtual sheet storage unit setting screen 511 has been selected (NO in step S709), the grouping setting unit 116 deletes the setting value of the sheet storage unit 114 from the grouping setting storage unit 117. Then, the grouping setting unit 116 deletes the sheet storage unit 114 itself as the virtual sheet storage unit to return to the sheet storage unit setting screen 501. Then, the processing proceeds to step S711.

In step S711, the grouping setting unit 116 waits for end instruction of the sheet storage unit setting screen 501.

When it is determined that the OK button 510 of the sheet storage unit setting screen 501 has been selected (YES in step S711), the grouping setting unit 116 closes the sheet storage unit setting screen 501 to end the sheet storage unit setting operation. On the other hand, when it is determined otherwise (NO in step S711), the processing proceeds to step S701, and waits for re-selection of the sheet storage section 114 or pressing of the new addition button 509.

Figure 8:
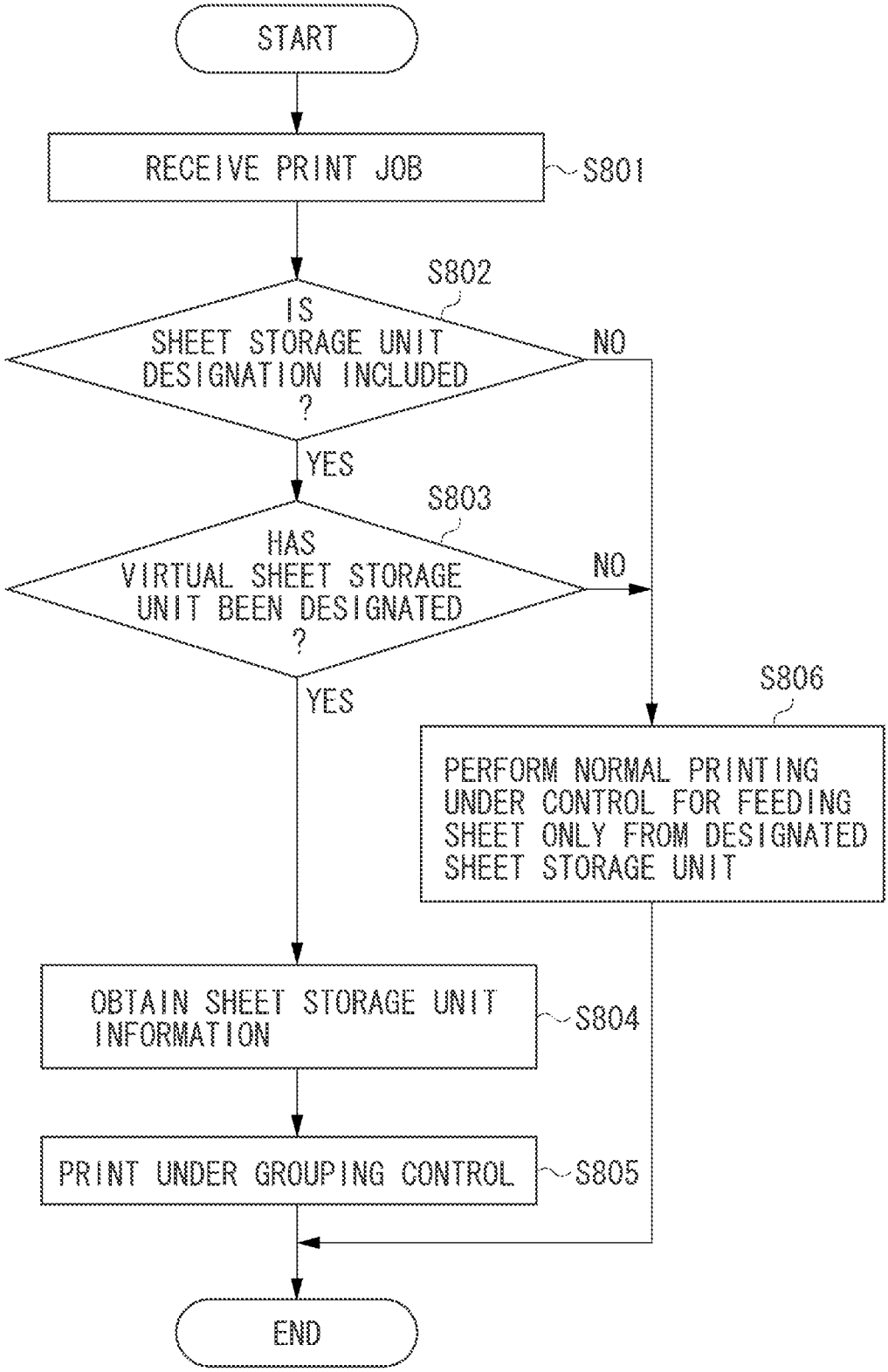
FIG. 8 is a flowchart illustrating a method for controlling the printing system.

FIG. 8 is a flowchart illustrating a method for controlling the printing system according to the present exemplary embodiment. This example is a printing operation example of the printing system. Each step is realized by executing a program stored in the storage unit 109 of the printing apparatus 102 by the print job processing unit 111.

In step S801, the print job processing unit 111 receives a print job from the host computer 101 to start processing of the printing system. The print job processing unit 111 temporarily spools the received print job in the storage unit 109. The print job is, for example, a print job transmitted from the host computer 101, a copy job or a stored data job executed by the printing apparatus 102, or a FAX job transmitted from the external device via a telephone line.

In step S802, the print job processing unit 111 analyzes the print job received from the host computer 101 to determine whether sheet storage unit designation is included in an attribute of the print job.

When it is determined that sheet storage unit designation is included in the attribute of the print job (YES in step S802), then in step S803, the print job processing unit 111 determines whether the sheet storage unit designation designates a sheet storage unit 114 that is a virtual sheet storage unit. Specifically, the print job processing unit 111 determines whether a sheet feeding source designated by the job is one of the sheet storage units. In other words, the print job processing unit 111 determines, on the setting screen illustrated in FIG. 9, which of a virtual sheet storage unit set by the user or an individual sheet storage unit the sheet feeding source is.

On the other hand, when it is determined otherwise by the print job processing unit 111 (NO in step S802), the processing proceeds to step S806.

When it is determined that the sheet storage unit designation designates the sheet storage unit 114 (YES in step S803), then in step S804, the print job processing unit 111 obtains grouping setting information as sheet storage unit information from the grouping setting storage unit 117. On the other hand, when it is determined otherwise (NO in step S803), the processing proceeds to step S806.

When it is determined to be "NO" in either step S802 or step S803, then in step S806, the print job processing unit 111 feeds, without carrying out grouping control using the plurality of sheet storage units 114, a sheet only from the designated sheet storage unit to execute printing, and ends the printing operation.

In step S805, the print job processing unit 111 performs printing processing based on grouping control using the plurality of sheet storage units 114 according to the sheet storage unit information set by the grouping setting unit 116, and then ends the printing processing.

According to the present exemplary embodiment, in the printing system, when grouping the sheet storage units, without changing originally defined control among the sheet storage units, a virtual sheet storage unit grouping one or a plurality of existing sheet storage units can be defined as a new sheet storage unit different from the existing sheet storage unit. As a result, the need of printing a great volume of print jobs by preventing sheet running-out as much as possible and the need of always feeding a sheet only from the designated sheet storage unit to perform printing can both be satisfied by using a more general-purpose standard method.

Further, in the printing system, when sheet feeding control is performed at the virtual sheet storage unit by grouping, a use amount of printing sheets fed from each sheet storage unit or an amount of printing sheets to be left in each sheet storage unit can be set. Thus, a great volume of print jobs can be printed by preventing sheet running-out as much as possible. Even when a sheet is always fed only from the designated sheet storage unit to perform printing, the printing can be carried out with limited sheet running-out.

Next, a second exemplary embodiment of the present invention will be described in detail referring to the drawings. Only difference of the present exemplary embodiment may be described, while overlapped descriptions may be omitted.

When feeding printing sheets, a printing apparatus generally performs sheet feeding control in a predetermined order according to an order of priority among sheet storage units and various conditions and states. In a case of printing a great volume of print jobs using grouping of the sheet storage units, it is desired to freely set an order of sheet feeding control among a plurality of sheet storage units grouped according to an operator's convenience, situation, desire, or intension.

Thus, according to the present exemplary embodiment, in addition to the first exemplary embodiment, a sheet storage unit order is designated when a sheet storage unit configuration is set during virtual sheet storage unit setting and, in a case of a print job of virtual sheet storage unit designation, sheet storage unit switching control is performed according to the order.

Figure 9:
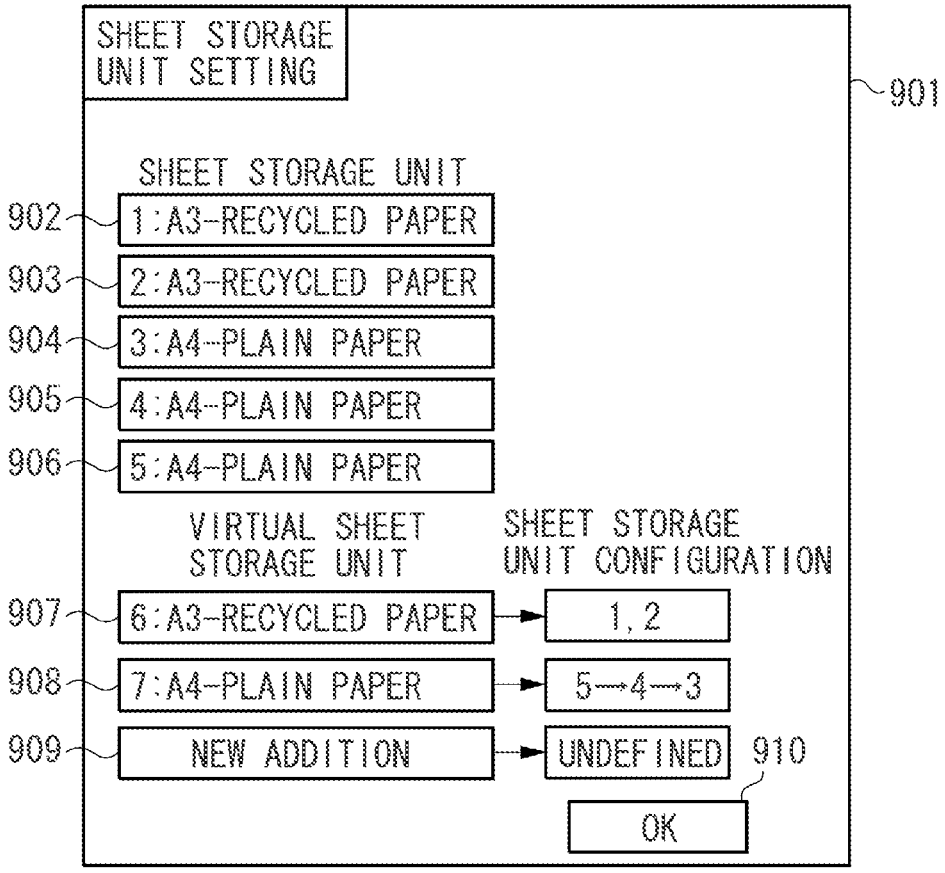
FIG. 9 is an explanatory diagram illustrating a virtual sheet storage unit setting screen for performing grouping setting of sheet storage units and a sheet storage unit setting screen for performing checking thereof.
Figure 9:
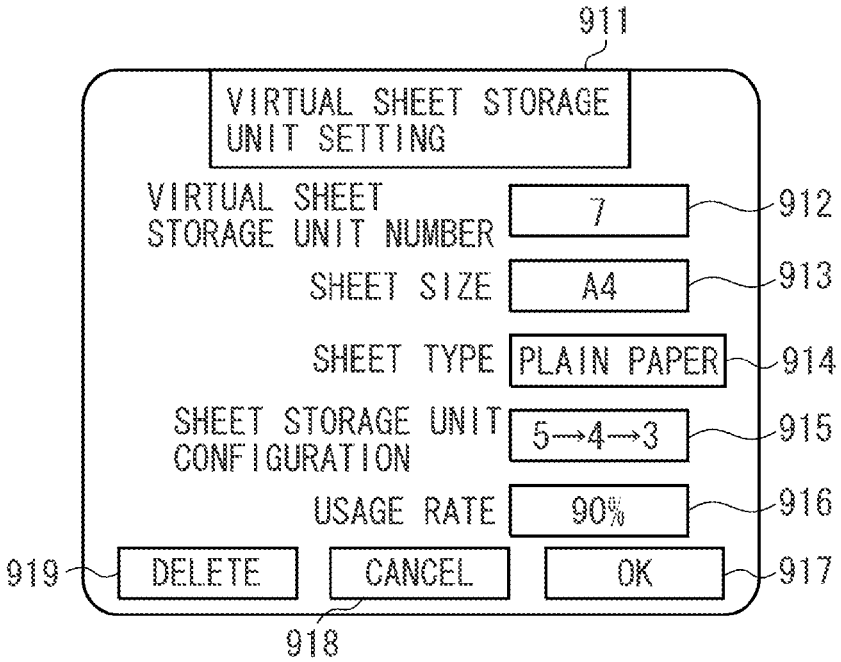

FIG. 9 is an explanatory diagram illustrating a virtual sheet storage unit setting screen for performing grouping setting of the sheet storage units included in the printing apparatus according to the present exemplary embodiment and a sheet storage unit setting screen for performing checking thereof. Hereinafter, referring to FIG. 9, sheet setting processing for setting a sheet size and a sheet type received in each sheet storage unit will be described.

In the present exemplary embodiment, concerning a plurality of sheet storage units 114, a sheet storage unit setting screen 901 for performing checking of setting of existing sheet storage units, grouping setting of a virtual sheet storage unit, and checking thereof is displayed by a grouping setting unit 116 using GUI via an operation unit 113 of the printing apparatus 102. FIG. 9 illustrates, as an example, a state where some grouping setting operations using a plurality of sheet storage units 114 as virtual sheet storage units have been carried out.

There are totally five existing sheet storage units 114. According to the sheet storage unit setting screen 901, a sheet storage unit 902 stores printing sheets of a sheet size "A3" and a sheet type "recycled paper".

Similarly, a sheet storage unit 903 stores printing sheets of a sheet size "A3" and a sheet type "recycled paper". A sheet storage unit 904 stores printing sheets of a sheet size "A4" and a sheet type "plain paper". Similarly, a sheet storage unit 905 stores printing sheets of a sheet size "A4" and a sheet type "plain paper". Similarly, a sheet storage unit 906 stores printing sheets of a sheet size "A4" and a sheet type "plain paper".

There are totally two existing sheet storage units 114 registered as virtual sheet storage units. According to the sheet storage unit setting screen 901, a sheet storage unit 907 stores printing sheets of a sheet size "A3" and a sheet type "recycled paper".

Sheet storage unit configurations of the sheet storage unit 907, i.e., the grouped existing sheet storage units 114, are the sheet storage unit 902 and the sheet storage unit 903. Accordingly, to perform sheet feeding control as the sheet storage unit 907, the sheet storage unit 902 and the sheet storage unit 903 are switched in this order to operate. A sheet storage unit 908 stores printing sheets of a sheet size "A4" and a sheet type "plain paper".

Sheet storage unit configurations of the sheet storage unit 908, i.e., the grouped existing sheet storage units 114, are the sheet storage units 904 to 906. Accordingly, to perform sheet feeding control as the sheet storage unit 908, the sheet storage unit 906, the sheet storage unit 905, and the sheet storage unit 904 are switched in this order to operate.

By pressing a new addition button 909 when a new sheet storage unit 114 as a virtual sheet storage unit is defined, a new virtual sheet storage unit can be added on a virtual sheet storage unit setting screen 911 to be described below.

When a user selects a GUI indicating the sheet storage unit 907 or the sheet storage unit 908 that is a virtual sheet storage unit via a touch panel of an operation unit 113, a grouping setting unit 116 displays the virtual sheet storage unit setting screen 911 for checking virtual sheet storage unit information or changing setting thereof.

By pressing the GUI of the new addition button 909 via the touch panel of the operation unit 113, the user can add a new sheet storage unit 114 that is a virtual sheet storage unit. FIG. 9 illustrates, as an example, sheet storage unit information of the sheet storage unit 908 that is a virtual sheet storage unit, and a changeable state. Needless to say, by pressing the new addition button 909, a new sheet storage unit 114 to which a new virtual sheet storage unit number and an attribute of a virtual sheet storage unit have been added can be added.

In virtual sheet storage unit setting, a virtual sheet feed unit number 912, a sheet size 913, a sheet type 914, a sheet storage unit configuration 915, and a sheet storage unit use rate 916 are present. A printing sheet of a virtual sheet storage unit number 912 of "7", a sheet size 913 of "A4", and a sheet type 914 of "plain paper" including the aforementioned description is currently stored, sheet storage unit configurations 915 are "3" to "5", and a sheet storage unit use rate 916 is 90%. To set or change the virtual sheet storage unit number 912, an arbitrary number is input. However, a sheet storage unit number added beforehand to the existing sheet storage unit 114 or a virtual sheet storage unit number of the other sheet storage unit 114 defined as a virtual sheet storage unit cannot be duplicated.

For example, numbers other than the sheet storage unit numbers 1 to 5 added beforehand to the existing sheet storage units 114 and a virtual sheet storage unit number 6 of the other sheet storage unit 114 defined beforehand as a virtual sheet storage unit, i.e., 7 or larger can be set.

In the present exemplary embodiment, the setting item is the virtual sheet storage unit number. However, not limited to the number, the setting item can be, for example, a name using a character string or another representation as long as it is unique information to identify the sheet storage unit 114. To set or change the sheet size 913, a sheet size storable in the sheet storage unit 114 of the printing apparatus 102, such as "A4", "A3", "letter", or "ledger", can be set on the screen.

For selection of a sheet size, a list of sheet size candidates can be displayed by selecting the GUI of the display unit of the sheet size 913, or the candidates can be displayed on a pop-up screen of another screen. Any method can be used as long as sheet sizes can be displayed and selected.

Exclusive control can be performed with a sheet type set in a sheet type 914 described below and storable sheet sizes of the existing sheet storage units 114 set in a sheet storage unit configuration 915. To set or change the sheet type 914, a sheet type storable in the sheet storage unit 114 of the printing apparatus 102, such as "plain paper", "thick paper", "coated paper", or "recycled paper", can be set on the screen. For selection of a sheet type, a list of sheet type candidates can be displayed by selecting the GUI of the display unit of the sheet size type 914, or the candidates can be displayed on a pop-up screen of another screen. Any method can be used as long as sheet types can be displayed and selected.

Exclusive control can be performed with a sheet size set in the sheet size 913 and storable sheet sizes of the existing sheet storage units 114 set in the sheet storage unit configuration 915 described below. To set and change the sheet storage unit configuration 915, arbitrary existing sheet storage units 114, i.e., one or more desired sheet storage units 114 are set from the sheet storage units 902 to 906.

The set sheet storage units 114 are grouped into one sheet storage unit, and targeted for sheet storage unit switching control in the group, and sheet storage unit switching control is performed in a designated order. For selection of the sheet storage units 114, a list of candidates of sheet storage units 114 can be displayed by selecting the GUI of the display unit of the sheet storage unit configuration 915.

Alternatively, the candidates can be displayed on a pop-up screen of another screen. Any method can be used as long as the existing sheet storage units 114 can be displayed and selected. Further, exclusive control can be performed with a sheet size set in the sheet size 913 and a sheet type set in the sheet type 914. To set or change the sheet storage unit use rate 916, an arbitrary use rate is input.

When a sheet storing number capacity of each of the existing sheet storage units 114 is 100%, at each sheet storage unit 114, printing sheets are used until the set sheet storage unit use rate is reached, and then sheet storage unit switching control is performed in the group. For example, when a maximum sheet storing number of each existing sheet storage unit to be targeted for the virtual sheet storage unit is 200, if the sheet storage unit use rate 916 is 90%, 1800 sheets are used from each existing sheet storage unit.

Remaining 10%, i.e., 200 sheets, is left on the sheet storage unit, and the processing is switched to another sheet storage unit in the group. In the present exemplary embodiment, the setting item is the sheet storage unit use rate. However, there is no limitation on use rate as long as a volume of sheets to be used can be set. Other representations such as a real use number can be used. Further, in the present exemplary embodiment, the setting item is the sheet storage unit use rate. However, a percentage of the number of sheets to be left in each sheet storage unit 114 or a real number can be set as in the case of sheet storage unit remaining amount designation.

To store the virtual sheet storage unit number 912, the sheet size 913, the sheet type 914, the sheet storage unit configuration 915, the sheet storage unit use rate 916, and virtual sheet storage unit setting thereof and return, an OK button 917 is selected. Then, the grouping setting unit 116 stores a setting value in a grouping setting storage unit 117, and returns to the sheet storage unit setting screen 901.

On the other hand, to return without storing the virtual sheet storage unit number 912, the sheet size 913, the sheet type 914, the sheet storage unit configuration 915, the sheet storage unit use rate 916, and virtual sheet storage unit setting thereof, a cancel button 918 is selected. Then, the grouping setting unit 116 returns to the sheet storage unit setting screen 901 without storing any setting value in the grouping setting storage unit 117.

Further, to delete registration of the sheet storage unit 114 itself defined as the virtual sheet storage unit, a delete button 919 is selected. Then, the grouping setting unit 116 deletes the setting value of the sheet storage unit 114 from the grouping setting storage unit 117, and deletes the sheet storage unit 114 itself defined as the virtual sheet storage unit to return to the sheet storage unit setting screen 901.

To end the sheet storage unit setting screen 901, an OK button 910 is selected. Accordingly, the grouping setting unit 116 ends the displaying of the sheet storage unit setting screen 901.

Figure 10:
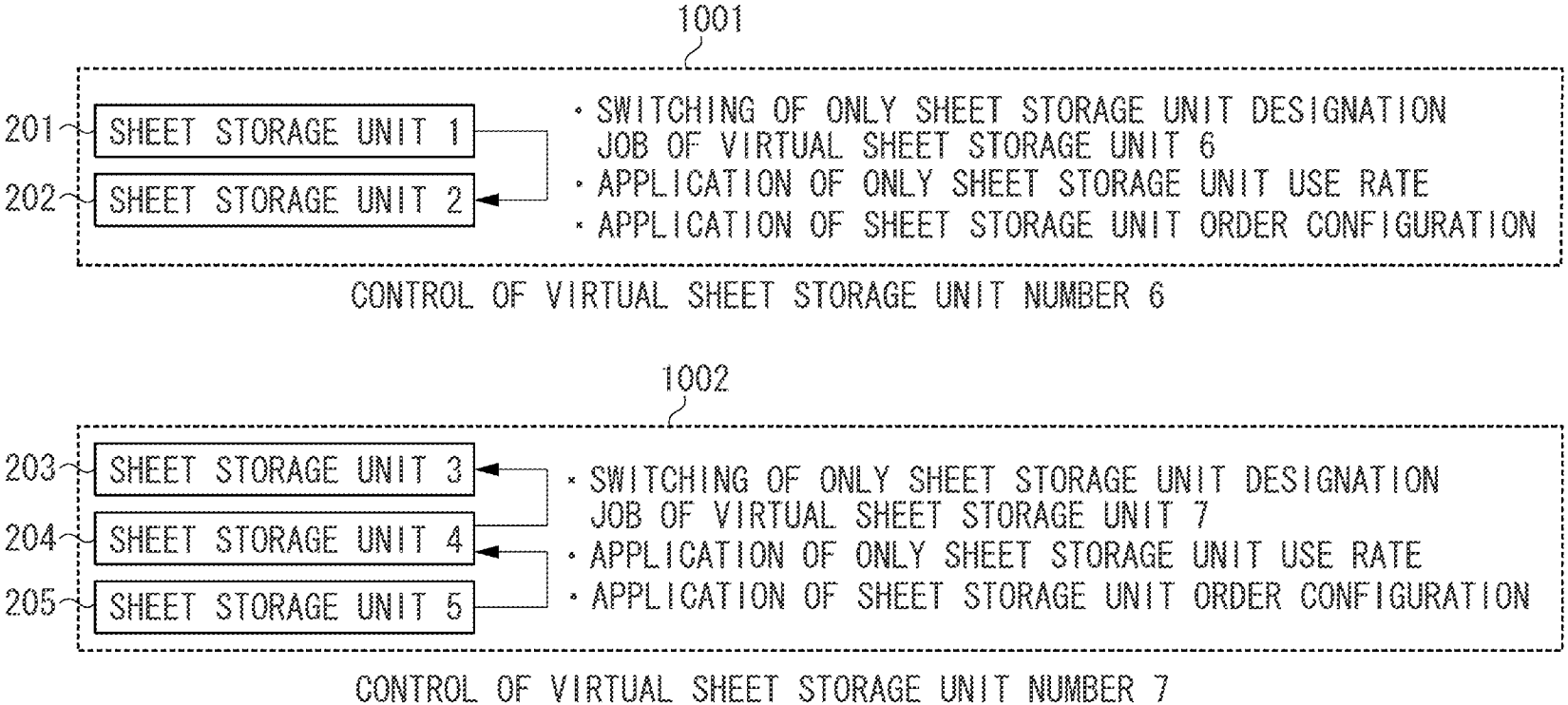
FIG. 10 is an explanatory diagram illustrating grouping control including a plurality of sheet storage units.

FIG. 10 is an explanatory diagram illustrating grouping control including the plurality of sheet storage units included in the printing apparatus according to the present exemplary embodiment.

In the present exemplary embodiment, the sheet storage unit 201 and the sheet storage unit 202 are grouped as a virtual sheet storage unit number 6. As the sheet storage unit use rate 516, for example, 90% is set. Further, a sheet feeding order is set as a sheet storage unit order configuration 915. For example, sheet feeding is designated in an order of the sheet storage unit 201 and the sheet storage unit 202.

As indicated by control 1001 of the virtual sheet storage unit number 6, when the virtual sheet storage unit is designated as a print job of sheet storage unit designation, and when a sheet use rate of one of the sheet storage units has reached 90%, the sheet storage unit is switched in an order of the sheet storage unit 201 and the sheet storage unit 202 to continue printing.

Specifically, in a case of a print job designating the sheet storage unit 507, when a sheet use rate of the sheet storage unit 201 has reached 90%, the print job processing unit 111 switches the sheet storage unit to the sheet storage unit 202 to continue the printing. On the other hand, because of control when a virtual sheet storage unit is designated, in a case of a print job designating the existing sheet storage unit such as the sheet storage unit 201 or the sheet storage unit 202, the print job processing unit 111 does not switch the sheet storage unit to continue the printing when sheet running-out occurs.

In FIG. 10, the sheet storage unit 203, the sheet storage unit 204, and the sheet storage unit 205 are grouped as a virtual sheet storage unit number 7. As the sheet storage unit use rate 516, for example, 90% is set. Further, a sheet feeding order is set as the sheet storage unit order configuration 915. For example, sheet feeding is designated in an order of the sheet storage unit 205, the sheet storage unit 204, and the sheet storage unit 203.

As indicated by control 1002 of the virtual sheet storage unit number 7, when the virtual sheet storage unit is designated as a print job of sheet storage unit designation, and when a sheet use rate of the sheet storage unit 114 currently feeding sheets has reached 90%, the sheet storage unit is switched in an order of the sheet storage units 205 to 203 to continue printing.

Specifically, in a case of a print job designating the sheet storage unit 908, when a sheet use rate of the sheet storage unit 205 has reached 90%, the print job processing unit 111 switches the sheet storage unit to the sheet storage unit 204 to continue the printing. When a sheet use rate of the sheet storage unit 204 has reached 90%, the print job processing unit 111 switches the sheet storage unit to the sheet storage unit 203 to continue the printing. On the other hand, because of control when a virtual sheet storage unit is designated, in a case of a print job designating the existing sheet storage unit such as the sheet storage units 203 to 205, the print job processing unit 111 does not switch the sheet storage unit to continue the printing when sheet running-out occurs.

Thus, in a case of the print job of sheet storage unit designation, control for always feeding sheets only from the designated sheet storage unit to perform printing is made valid while printing from an undesignated sheet storage unit is prevented. By feeding printing sheets by the designated order and continuously printing a great volume of print jobs by preventing sheet running-out as much as possible, productivity of print products can be improved at the printing apparatus. These can be simultaneously satisfied by using a more general-purpose standard method. Further, by leaving printing sheets in the respective sheet storage units 114, sheet running-out can be made difficult to occur even when the sheet storage unit 114 where sheet running-out easily occurs due to the influence of a use frequency by sheet storage unit switching control in the group of the virtual sheet storage units is used in the print job of sheet storage unit designation.

Figure 11:
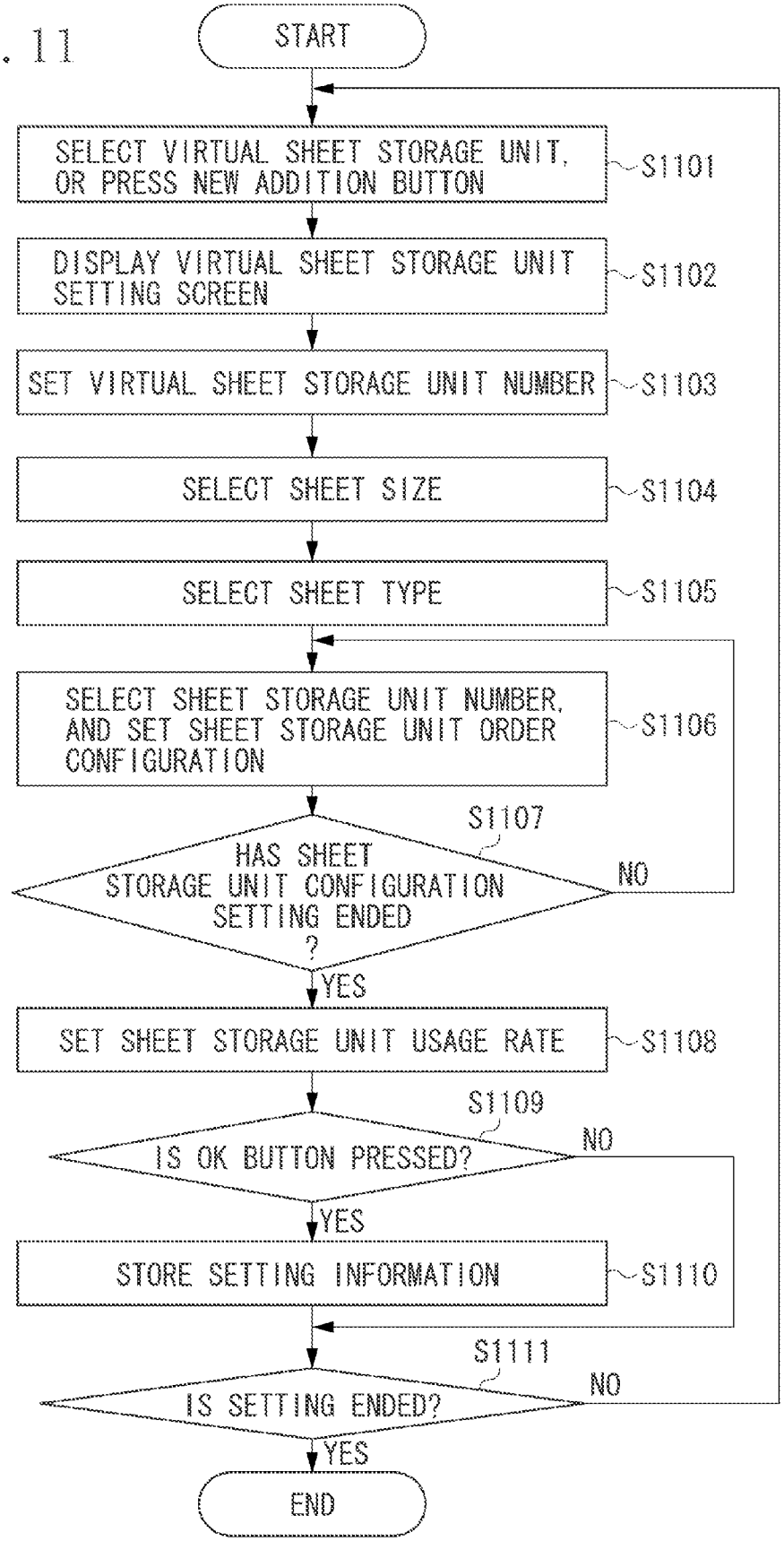
FIG. 11 is a flowchart illustrating a method for controlling the printing system.

FIG. 11 is a flowchart illustrating a method for controlling the printing system according to the present exemplary embodiment. This example is an operation example of sheet storage unit setting. Each step is realized by executing a program stored in the storage unit 109 of the printing apparatus 102 by the grouping setting unit 116.

When the operation unit 113 of the printing apparatus 102 calls up the sheet storage unit setting screen 901, the grouping setting unit 116 starts the operation.

In step S1101, the grouping setting unit 116 detects selection of a sheet storage unit 114 that has been defined as a virtual sheet storage unit or pressing of the new addition button 909 from the sheet storage unit setting screen 901.

In step S1102, the grouping setting unit 116 displays the sheet storage unit 114 or the virtual sheet storage unit setting screen 911 for new addition.

In step S1103, when new setting or changing of the virtual sheet storage unit number 912 is instructed, the grouping setting unit 116 stores a number as unique information to identify the input sheet storage unit 114.

In step S1104, when new setting or changing of the sheet size 913 is instructed, the grouping setting unit 116 displays sheet size candidates storable in the sheet storage unit 114 to store a selected sheet size.

In step S1105, when new setting or changing of the sheet type 914 is instructed, the grouping setting unit 116 displays sheet type candidates storable in the sheet storage unit 114 to store a selected sheet type.

In step S1106, when new setting or changing of the sheet storage unit configuration 915 is instructed, the grouping setting unit 116 displays existing sheet storage units 114 that will be grouping candidates to store a selected sheet storage units 114 in the selected order.

In step S1107, the grouping setting unit 116 determines whether sheet storage unit selection of the sheet storage unit configuration 915 has been ended.

When ended (YES in step S1107), then in step S1108, when new setting or changing of the sheet storage unit use rate 916 is instructed, the grouping setting unit 116 stores a percentage value defining a sheet use amount of each input sheet storage unit 114. On the other hand, when it is determined otherwise (NO in step S1107), to continue the sheet storage unit selection of the sheet storage unit configuration 915, the processing proceeds to step S1106.

In step S1109, the grouping setting unit 116 waits for end instruction (OK button pressing) on the virtual sheet storage unit setting screen 911.

When it is determined that the OK button 917 of the virtual sheet storage unit setting screen 911 has been selected (YES in step S1109), then in step S1110, the grouping setting unit 116 stores each setting value in the grouping setting storage unit 117. Then, the processing returns to the sheet storage unit setting screen 901. On the other hand, when it is determined that a cancel button 918 of the virtual sheet storage unit setting screen 911 has been selected (NO in step S1109), the grouping setting unit 116 returns to the sheet storage unit setting screen 901 without storing any current setting value in the grouping setting storage unit 117.

When it is determined that a delete button 919 of the virtual sheet storage unit setting screen 911 has been selected (NO in step S1109), the grouping setting unit 116 deletes the setting value of the sheet storage unit 114 from the grouping setting storage unit 117. Then, the grouping setting unit 116 deletes the sheet storage unit 114 itself as the virtual sheet storage unit to return to the sheet storage unit setting screen 901. Then, the processing proceeds to step S1111. In step S1111, the grouping setting unit 116 waits for end instruction of the sheet storage unit setting screen 901.

When it is determined that an OK button 910 of the sheet storage unit setting screen 901 has been selected (YES in step S1111), the grouping setting unit 116 closes the sheet storage unit setting screen 901 to end the sheet storage unit setting operation. On the other hand, when it is determined otherwise (NO in step S1111), the processing proceeds to step S1101, and waits for re-selection of the sheet storage section 114 or pressing of the new addition button 909.

Figure 12:
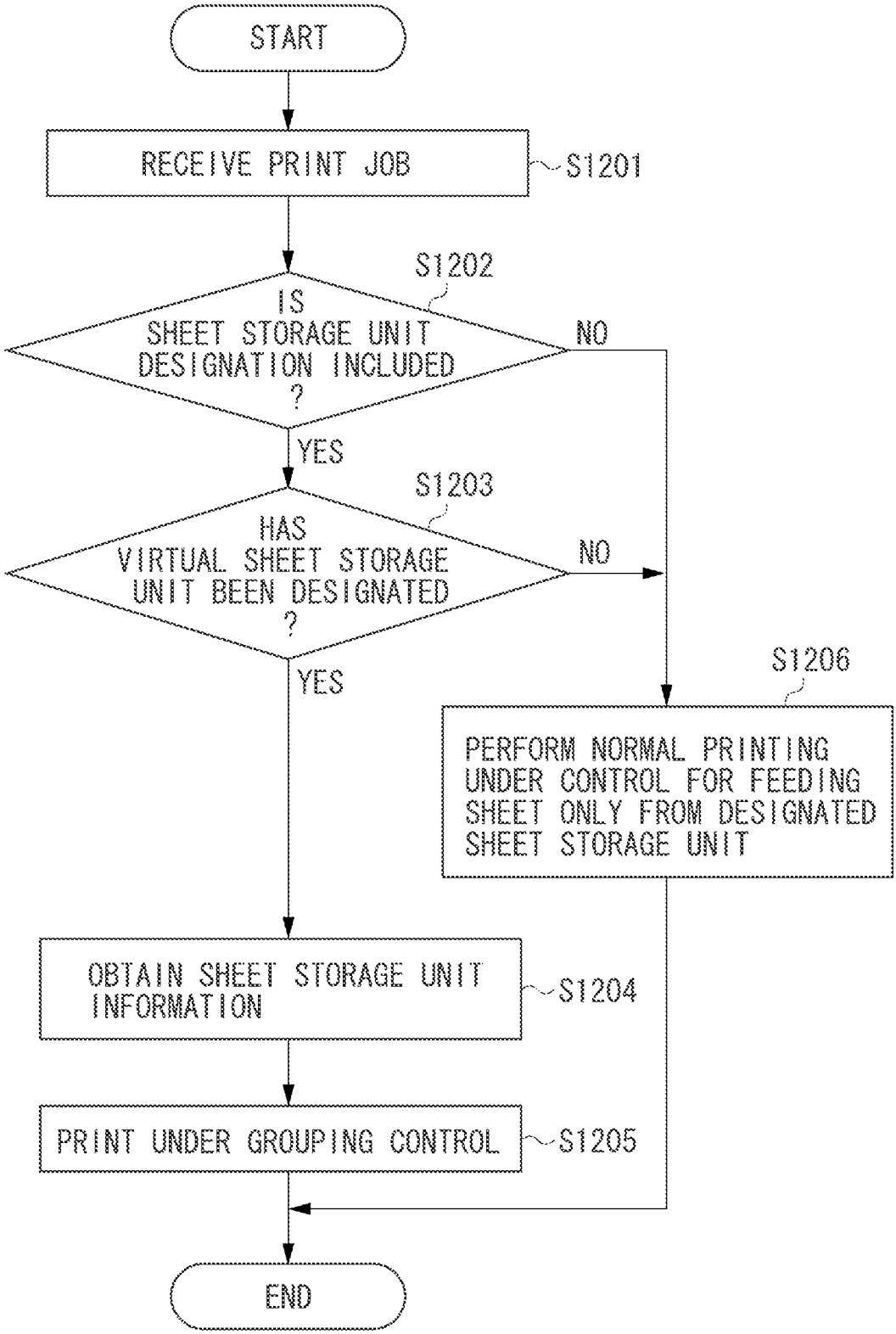
FIG. 12 is a flowchart illustrating a method for controlling the printing system.

FIG. 12 is a flowchart illustrating a method for controlling the printing system according to the present exemplary embodiment. This example is a printing operation example of the printing system. The flowchart is realized by executing a program stored in the storage unit 109 of the printing apparatus 102 by a print job processing unit 111.

In step S1201, the print job processing unit 111 receives a print job to start processing of the printing system. The print job processing unit 111 temporarily spools the received print job in the storage unit 109. The print job is, for example, a print job transmitted from the host computer 101, a copy job or a stored data job executed by the printing apparatus 102, or a FAX job transmitted from an external device via a telephone line.

In step S1202, the print job processing unit 111 analyzes the received print job to determine whether sheet storage unit designation is included in an attribute of the print job.

When it is determined that sheet storage unit designation is included in the attribute of the print job (YES in step S1202), then in step S1203, the print job processing unit 111 determines whether the sheet storage unit designation designates a sheet storage unit 114 that is a virtual sheet storage unit. On the other hand, when it is determined otherwise (NO in step S1202), the processing proceeds to step S1206.

When it is determined that the sheet storage unit designation designates the sheet storage unit 114 (YES in step S1203), then in step S1204, the print job processing unit 111 obtains grouping setting information as sheet storage unit information from the grouping setting storage unit 117. On the other hand, when it is determined otherwise (NO in step S1203), the processing proceeds to step S1206.

When it is determined to be NO in either step S1202 or step S1203, then in step S1206, the print job processing unit 111 continuously feeds, without carrying out grouping control using the plurality of sheet storage units 114, sheets only from the designated sheet storage unit to execute printing, and ends the printing operation.

In step S1205, the print job processing unit 111 performs printing processing based on grouping control using the plurality of sheet storage units 114 according to the sheet storage unit information set by the grouping setting unit 116, and then ends the printing processing. During the grouping control, the sheet storage units 114 are switched by the order set in the sheet storage unit order information 915 to perform the print processing.

According to the present exemplary embodiment, in the printing system, the sheet storage unit order is set when the sheet storage unit configurations are set during the virtual sheet storage unit setting, in a case of the print job of virtual sheet storage unit designation, sheet storage unit switching control can be performed according to the order. As a result, in addition to the effects of the first exemplary embodiment, an order of sheet feeding control can be freely set among a plurality of sheet storage units grouped according to an operator's convenience, situation, desire, or intension.

Next, a third exemplary embodiment of the present invention will be described in detail with reference to FIG. 13. Only difference of the present exemplary embodiment may be described, while overlapped descriptions may be omitted.

According to the first embodiment, the need of printing a great volume of print jobs by preventing sheet running-out as much as possible and the need of always feeding sheets only from the designated sheet storage unit to perform printing can both be satisfied with equal priority. In a case of performing print processing especially by combining a plurality of sheet storage units through grouping during printing of the great volume of print jobs, it is desired to continue the printing without sheet running-out as much as possible to increase productivity of print products.

Thus, according to the present exemplary embodiment, in addition to the first exemplary embodiment, a mode for prohibiting, while setting of a virtual sheet storage unit is valid, use of sheet storage units subjected to grouping at the virtual sheet storage unit in all print jobs other than a print job designating the virtual sheet storage unit is set, and its control is performed.

Figure 13:
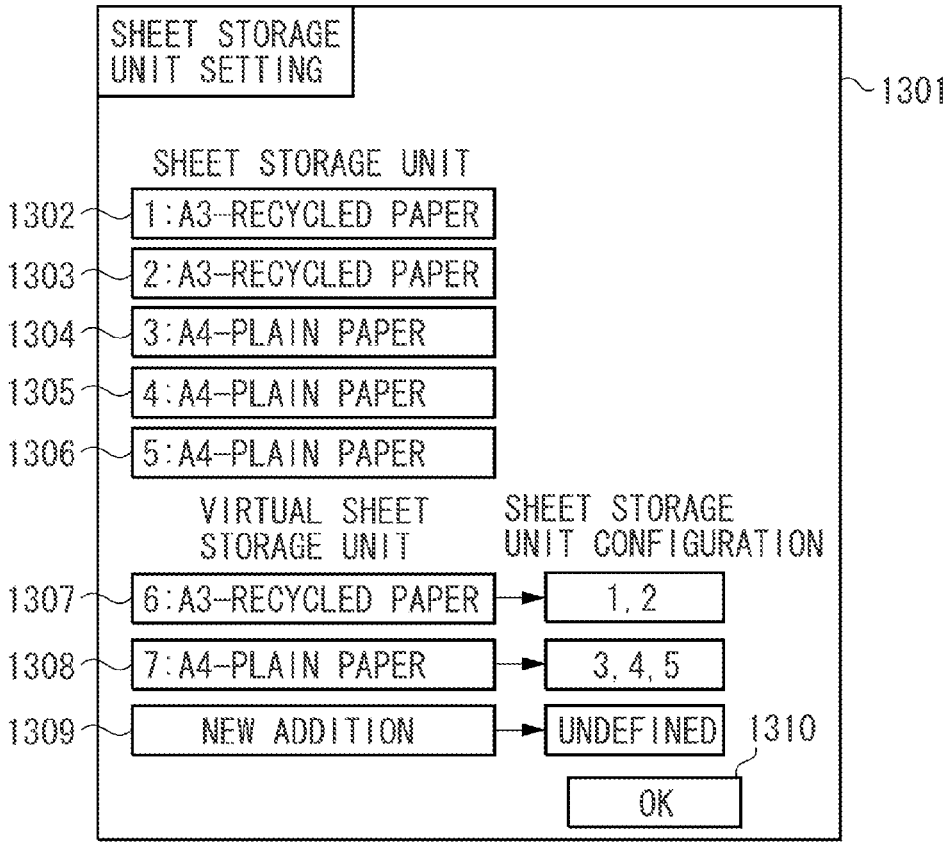
FIG. 13 is an explanatory diagram illustrating a virtual sheet storage unit setting screen for performing grouping setting of sheet storage units included in the printing apparatus and a sheet storage unit setting screen for performing checking thereof.
Figure 13:
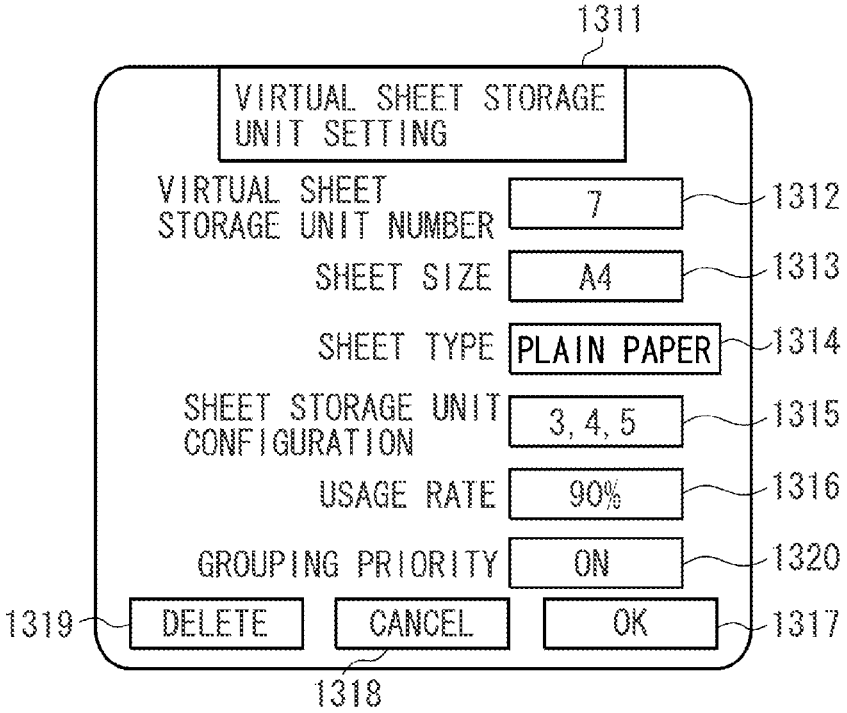

FIG. 13 is an explanatory diagram illustrating a virtual sheet storage unit setting screen for performing grouping setting of the sheet storage units included in a printing apparatus according to the present exemplary embodiment and a sheet storage unit setting screen for performing checking thereof.

In FIG. 13, concerning a plurality of sheet storage units 114, a sheet storage unit setting screen 1301 for performing checking of setting of existing sheet storage units, grouping setting of a virtual sheet storage unit, and checking thereof is displayed by a grouping setting unit 116 using GUI via an operation unit 113 of the printing apparatus 102. FIG. 13 illustrates, as an example, a state where some grouping setting operations using a plurality of sheet storage units 114 as virtual sheet storage units have been carried out.

There are totally five existing sheet storage units 114. According to the sheet storage unit setting screen 1301, a sheet storage unit 1302 stores printing sheets of a sheet size "A3" and a sheet type "recycled paper". Similarly, a sheet storage unit 1303 stores printing sheets of a sheet size "A3" and a sheet type "recycled paper". A sheet storage unit 1304 stores printing sheets of a sheet size "A4" and a sheet type "plain paper". Similarly, a sheet storage unit 1305 stores printing sheets of a sheet size "A4" and a sheet type "plain paper". Similarly, a sheet storage unit 1306 stores printing sheets of a sheet size "A4" and a sheet type "plain paper".

There are totally two existing sheet storage units 114 registered as virtual sheet storage units. According to the sheet storage unit setting screen 1301, a sheet storage unit 1307 stores printing sheets of a sheet size "A3" and a sheet type "recycled paper". Sheet storage unit configurations of the sheet storage unit 1307, i.e., the grouped existing sheet storage units 114, are the sheet storage unit 1302 and the sheet storage unit 1303.

Accordingly, to perform sheet feeding control as the sheet storage unit 1307, the sheet storage unit 1302 and the sheet storage unit 1303 are switched to operate. A sheet storage unit 1308 stores printing sheets of a sheet size "A4" and a sheet type "plain paper". Sheet storage unit configurations of the sheet storage unit 1308, i.e., the grouped existing sheet storage units 114, are the sheet storage units 1304 to 1306. Accordingly, to perform sheet feeding control as the sheet storage unit 1308, the sheet storage units 1304 to 1306 are switched to operate.

By pressing a new addition button 1309 when a new sheet storage unit 114 as a virtual sheet storage unit is defined, a new virtual sheet storage unit can be added on a virtual sheet storage unit setting screen 1311 to be described below.

When a user selects a GUI indicating the sheet storage unit 1307 or the sheet storage unit 1308 that is a virtual sheet storage unit via a touch panel of an operation unit 113, a grouping setting unit 116 displays the virtual sheet storage unit setting screen 1311 for checking virtual sheet storage unit information or changing setting thereof. By pressing the GUI of the new addition button 1309 via the touch panel of the operation unit 113, the user can add a new sheet storage unit 114 that is a virtual sheet storage unit. FIG. 13 illustrates, as an example, sheet storage unit information of the sheet storage unit 1308 that is a virtual sheet storage unit, and a changeable state.

Needless to say, by pressing the new addition button 1309, a new sheet storage unit 114 to which a new virtual sheet storage unit number and an attribute of a virtual sheet storage unit have been added can be added.

In virtual sheet storage unit setting, a virtual sheet storage unit number 1312, a sheet size 1313, a sheet type 1314, a sheet storage unit configuration 1315, a sheet storage unit use rate 1316, and grouping priority 1320 are present. A printing sheet of a virtual sheet storage unit number 1312 of "7", a sheet size 1313 of "A4", and a sheet type 1314 of "plain paper" including the aforementioned description is currently stored, sheet storage unit configurations 1315 are "3" to "5", and a sheet storage unit use rate 1316 is 90%. To set or change the virtual sheet storage unit number 1312, an arbitrary number is input.

However, a sheet storage unit number added beforehand to the existing sheet storage unit 114 or a virtual sheet storage unit number of the other sheet storage unit 114 defined as a virtual sheet storage unit cannot be duplicated. For example, numbers other than sheet storage unit numbers 1 to 5 added beforehand to the existing sheet storage units 114 and a virtual sheet storage unit number 6 of the other sheet storage unit 114 defined beforehand as a virtual sheet storage unit, i.e., "7" or larger can be set.

In the present exemplary embodiment, the setting item is the virtual sheet storage unit number. However, not limited to the number, the setting item can be, for example, a name using a character string or another representation as long as it is unique information to identify a sheet storage unit 114. To set or change the sheet size 1313, a sheet size storable in the sheet storage unit 114 of the printing apparatus 102, such as "A4", "A3", "letter", or "ledger", can be set on the screen. For selection of a sheet size, a list of sheet size candidates can be displayed by selecting the GUI of the display unit of the sheet size 1313, or the candidates can be displayed on a pop-up screen of another screen. Any method can be used as long as sheet sizes can be displayed and selected.

Exclusive control can be performed with a sheet type set in a sheet type 1314 described below and storable sheet sizes of the existing sheet storage units 114 set in a sheet storage unit configuration 1315. To set or change the sheet type 1314, a sheet type storable in the sheet storage unit 114 of the printing apparatus 102, such as "plain paper", "thick paper", "coated paper", or "recycled paper", can be set on the screen.

For selection of a sheet type, a list of sheet type candidates can be displayed by selecting the GUI of the display unit of the sheet size type 1314, or the candidates can be displayed on a pop-up screen of another screen. Any method can be used as long as sheet types can be displayed and selected. Exclusive control can be performed with a sheet size set in the sheet size 1313 and storable sheet sizes of the existing sheet storage units 114 set in the sheet storage unit configuration 1315 to be described below.

To set and change the sheet storage unit configuration 1315, arbitrary existing sheet storage units 114, i.e., one or more desired sheet storage units 114 are set from the sheet storage units 1302 to 1306. The set sheet storage units 114 are grouped into one sheet storage unit, and targeted for sheet storage unit switching control in the group.

For selection of the sheet storage units 114, a list of candidates of sheet storage units 114 can be displayed by selecting the GUI of the display unit of the sheet storage unit configuration 1315. Alternatively, the candidates can be displayed on a pop-up screen of another screen. Any method can be used as long as the existing sheet storage units 114 can be displayed and selected.

Further, exclusive control can be performed with a sheet size set in the sheet size 1313 and a sheet type set in the sheet type 1314. To set or change the sheet storage unit use rate 1316, an arbitrary use rate is input.

When a sheet storing number capacity of each of the existing sheet storage units 114 is 100%, at each sheet storage unit 114, a printing sheet is used until the set sheet storage unit use rate is reached, and then sheet storage unit switching control is performed in the group.

For example, when a maximum sheet storing number of each existing sheet storage unit to be targeted for the virtual sheet storage unit is 2000, if the sheet storage unit use rate 1316 is 90%, 1800 sheets are used from each existing sheet storage unit. Remaining 10%, i.e., 200 sheets, is left on the sheet storage unit, and the processing is switched to another sheet storage unit in the group. In the present exemplary embodiment, the setting item is the sheet storage unit use rate. However, there is no limitation on use rate as long as a volume of sheets to be used can be set. Other representations such as a real use number can be used.

Further, in the present exemplary embodiment, the setting item is the sheet storage unit use rate. However, a percentage of the number of sheets to be left in each sheet storage unit 114 or a real number may be set as in the case of sheet storage unit remaining amount designation. To set or change the grouping priority 1320, ON or OFF is selected. For selection of the grouping priority, a list of setting candidates of grouping priority can be displayed by selecting the GUI of the display unit of the grouping priority 1320. Alternatively, the setting candidates can be displayed on a pop-up screen of another screen. Any method can be used as long as grouping priority setting choices can be displayed and selected.

When ON is selected in the grouping priority 1320, while the virtual sheet storage unit 114 generated by the grouping setting unit 116 continues to be present, use of each sheet storage unit 114 constituting the virtual sheet storage unit is prohibited at a print job other than a print job designating the virtual sheet storage unit as a sheet storage unit.

In other words, priority is placed on, among the print jobs designating sheet storage unit, the print job designating the virtual sheet storage unit. When OFF is selected in the grouping priority 1320, no priority order is set concerning use of the sheet storage units 114 according to the print job. Further, in the present exemplary embodiment, when the grouping priority 1320 is ON, a period of priority placed on the sheet storage unit 114 used in the virtual sheet storage unit is a period where the virtual sheet storage unit continues to be present. However, this period may be limited to a period where the virtual sheet storage unit is designated by the print job and processed at a print job processing unit 111.

To store the virtual sheet storage unit number 1312, the sheet size 1313, the sheet type 1314, the sheet storage unit configuration 1315, the sheet storage unit use rate 1316, the grouping priority 1320, and virtual sheet storage unit setting thereof and return, an OK button 1317 is selected. Then, the grouping setting unit 116 stores a setting value in a grouping setting storage unit 117, and returns to the sheet storage unit setting screen 1301.

On the other hand, to return without storing the virtual sheet storage unit number 1312, the sheet size 1313, the sheet type 1314, the sheet storage unit configuration 1315, the sheet storage unit use rate 1316, the grouping priority 1320, and virtual sheet storage unit setting thereof, a cancel button 1318 is selected. Then, the grouping setting unit 116 returns to the sheet storage unit setting screen 1301 without storing any setting value in the grouping setting storage unit 117.

Further, to delete registration of the sheet storage unit 114 itself defined as the virtual sheet storage unit, a delete button 1319 is selected. Then, the grouping setting unit 116 deletes the setting value of the sheet storage unit 114 from the grouping setting storage unit 117, and deletes the sheet storage unit 114 itself defined as the virtual sheet storage unit to return to the sheet storage unit setting screen 1301.

To end the sheet storage unit setting screen 1301, an OK button 1310 is selected. Accordingly, the grouping setting unit 116 ends the displaying of the sheet storage unit setting screen 1301.

Figure 14:
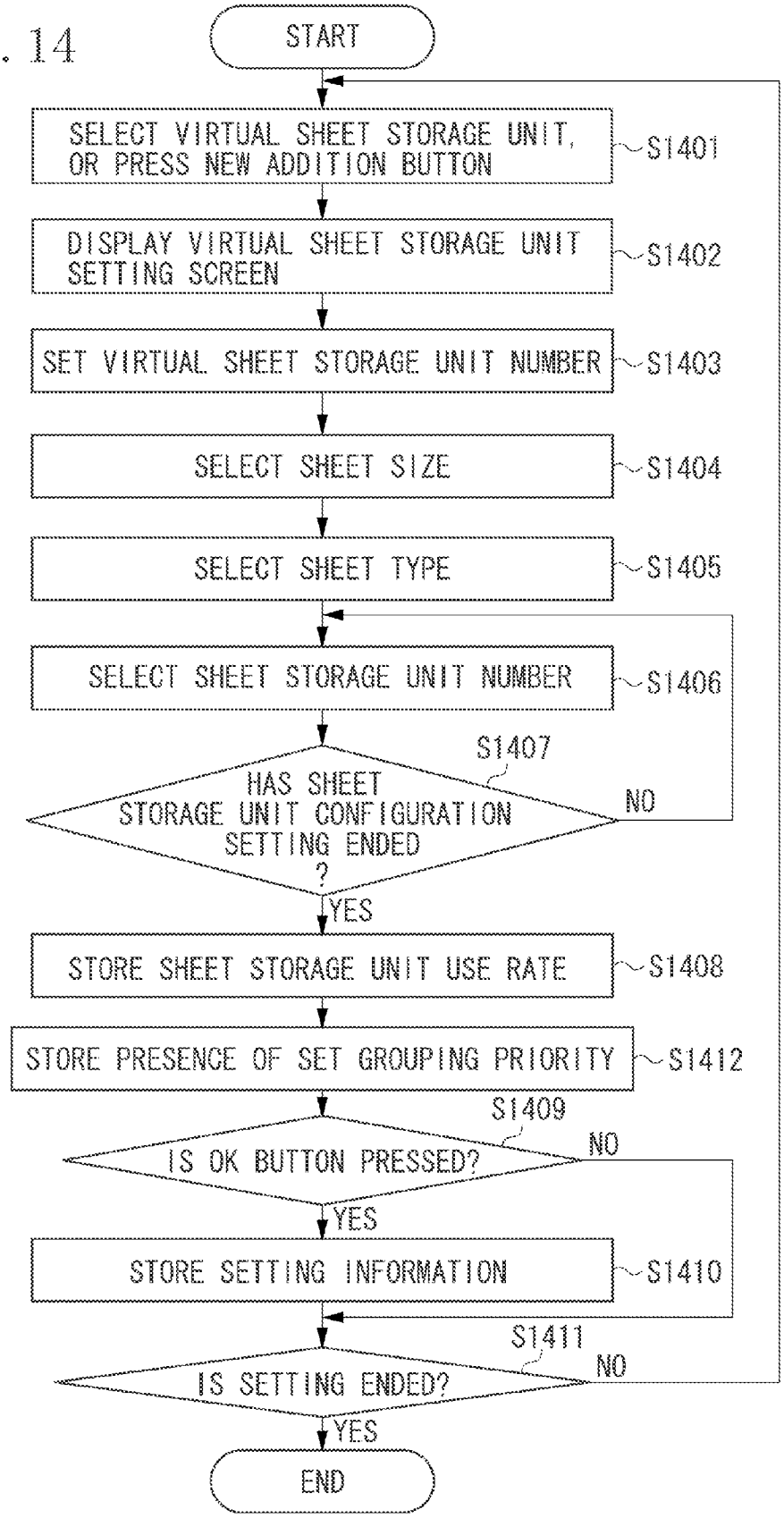
FIG. 14 is a flowchart illustrating a method for controlling the printing system.

FIG. 14 is a flowchart illustrating a method for controlling the printing system according to the present exemplary embodiment. This example is a sheet storage unit setting example in the printing system. Each step is realized by executing a program stored in the storage unit 109 of the printing apparatus 102 by the grouping setting unit 116.

When the operation unit 113 of the printing apparatus 102 calls up the sheet storage unit setting screen 1301, the grouping setting unit 116 starts the operation.

In step S1401, the grouping setting unit 116 detects selection of a sheet storage unit 114 that has been defined as a virtual sheet storage unit or pressing of the new addition button 1309 from the sheet storage unit setting screen 1301.

In step S1402, the grouping setting unit 116 displays the sheet storage unit 114 or the virtual sheet storage unit setting screen 1311 for new addition.

In step S1403, when new setting or changing of the virtual sheet storage unit number 1312 is instructed, the grouping setting unit 116 stores a number as unique information to identify the input sheet storage unit 114.

In step S1404, when new setting or changing of the sheet size 1313 is instructed, the grouping setting unit 116 displays sheet size candidates storable in the sheet storage unit 114 to store a selected sheet size.

In step S1405, when new setting or changing of the sheet type 1314 is instructed, the grouping setting unit 116 displays sheet type candidates storable in the sheet storage unit 114 to store a selected sheet type.

In step S1406, when new setting or changing of the sheet storage unit configuration 1315 is instructed, the grouping setting unit 116 displays existing sheet storage units 114 that are grouping candidates to store a selected sheet storage unit.

In step S1407, the grouping setting unit 116 determines whether sheet storage unit selection of the sheet storage unit configuration 1315 has been ended.

When ended (YES in step S1407), then in step S1408, when new setting or changing of the sheet storage unit use rate 1316 is instructed, the grouping setting unit 116 stores a percentage value defining a sheet use amount of each input sheet storage unit 114. On the other hand, when it is determined otherwise (NO in step S1407), to continue the sheet storage unit selection of the sheet storage unit configuration 1315, the processing proceeds to step S1406.

In step S1412, when new setting or changing of the grouping priority 1320 is instructed, the grouping setting unit 116 displays ON or OFF as a candidate, and stores presence of selected grouping priority.

In step S1409, the grouping setting unit 116 waits for end instruction for the virtual sheet storage unit setting screen 1311.

When it is determined that the OK button 1317 of the virtual sheet storage unit setting screen 1311 has been selected (YES in step S1409), then in step S1410, the grouping setting unit 116 stores each setting value in the grouping setting storage unit 117. Then, the processing returns to the sheet storage unit setting screen 1301.

On the other hand, when it is determined that a cancel button 1318 of the virtual sheet storage unit setting screen 1311 has been selected (NO in step S1409), the grouping setting unit 116 returns to the sheet storage unit setting screen 1301 without storing any current setting value in the grouping setting storage unit 117.

When it is determined that a delete button 1319 of the virtual sheet storage unit setting screen 1311 has been selected (NO in step S1409), the grouping setting unit 116 deletes the setting value of the sheet storage unit 114 from the grouping setting storage unit 117. Then, the grouping setting unit 116 deletes the sheet storage unit 114 itself as the virtual sheet storage unit to return to the sheet storage unit setting screen 1301. Then, the processing proceeds to step S1411.

In step S1411, the grouping setting unit 116 waits for end instruction of the sheet storage unit setting screen 1301.

When it is determined that an OK button 1310 of the sheet storage unit setting screen 1301 has been selected (YES in step S1411), the grouping setting unit 116 closes the sheet storage unit setting screen 1301 to end the sheet storage unit setting operation. On the other hand, when it is determined otherwise (NO in step S1411), the processing proceeds to step S1401, and waits for re-selection of the sheet storage unit section 114 or pressing of the new addition button 1309.

Figure 15:
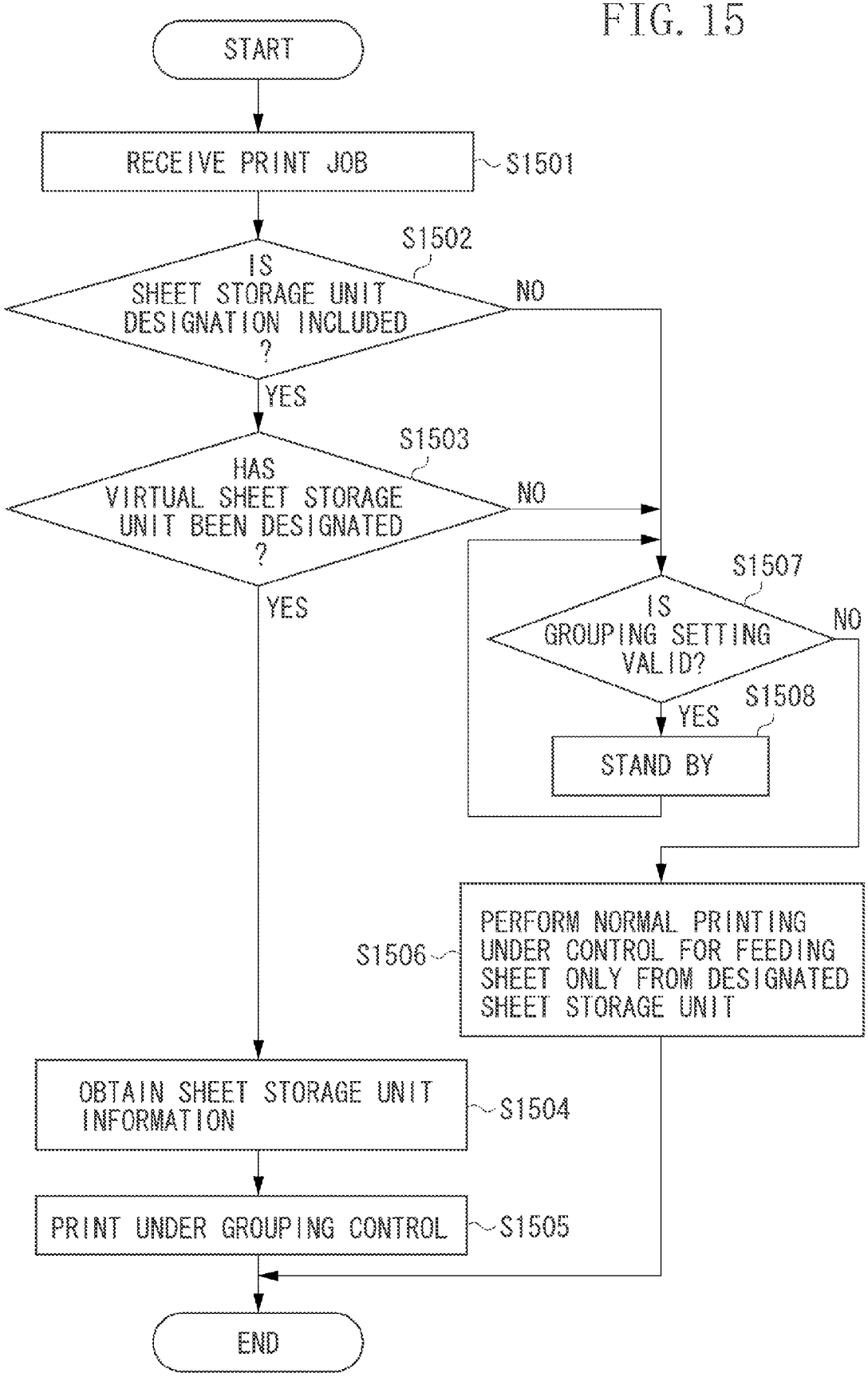
FIG. 15 is a flowchart illustrating a method for controlling the printing system.

FIG. 15 is a flowchart illustrating a method for controlling the printing system according to the present exemplary embodiment. This example is a printing operation example of the printing system. Each step is realized by executing a program stored in the storage unit 109 of the printing apparatus 102 by a print job processing unit 111.

In step S1501, the print job processing unit 111 receives a print job to start processing of the printing system. The print job processing unit 111 temporarily spools the received print job in the storage unit 109. The print job is, for example, a print job transmitted from a host computer 101, a copy job or a stored data job executed by the printing apparatus 102, or a FAX job transmitted from an external device via a telephone line.

In step S1502, the print job processing unit 111 analyzes the received print job to determine whether sheet storage unit designation is included in an attribute of the print job.

When it is determined that sheet storage unit designation is included in the attribute of the print job (YES in step S1502), then in step S1503, the print job processing unit 111 determines whether the sheet storage unit designation designates a sheet storage unit 114 that is a virtual sheet storage unit. On the other hand, when it is determined otherwise (NO in step S1502), the processing proceeds to step S1507.

When it is determined to be YES in step S1503, then in step S1504, the print job processing unit 111 obtains grouping setting information as sheet storage unit information from the grouping setting storage unit 117. On the other hand, when it is determined to be NO in step S1502, the processing proceeds sp step S1507.

When it is determined to be NO in either step S1502 or step S1503, then in step S1507, the print job processing unit 111 determines whether the sheet storage unit 114 as the virtual sheet storage unit is present in the printing apparatus 102 and duplicated with the sheet storage unit 114 used at the print job.

When it is determined to be duplicated (YES in step S1507), then in step S1508, the print job processing unit 111 interrupts the print processing of the print job to stand by, and then the processing proceeds to step S1507. In other words, while setting of the virtual sheet storage unit is valid, priority is placed on the sheet storage unit 114 used as the virtual sheet storage unit, and use of sheet storage units 114 targeted at other print jobs is prohibited. On the other hand, when it is determined not to be duplicated (NO in step S1507), then in step S1506, without executing grouping control using a plurality of sheet storage units 114, normal printing is performed by continuously feeding sheets only from the designated sheet storage unit, and the printing operation is ended.

In step S1505, the print job processing unit 111 performs printing processing based on grouping control using the plurality of sheet storage units 114 according to the sheet storage unit information set by the grouping setting unit 116, and then ends the printing processing.

According to the present exemplary embodiment, in the printing system, the mode for prohibiting, while setting of the virtual sheet storage unit is valid, use of sheet storage units subjected to grouping at the virtual sheet storage unit in all the print jobs other than the print job designating the virtual sheet storage unit is set, and its control can be performed. As a result, in addition to the effects of the first exemplary embodiment, while maintaining the need of always feeding a sheet only from the designated sheet storage unit to perform printing, the need of printing a greater volume of print jobs without any sheet running-out with higher productivity than the first exemplary embodiment can be satisfied.

The present invention is not limited to the above-described exemplary embodiments. Various changes (including organic combinations of the exemplary embodiments) can be made based on teachings of the present invention, which are not outside the scope of the invention.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment (s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-255153 filed Nov. 21, 2012, which is hereby incorporated by reference herein in its entirety.

What is claimed is:

1. A printing apparatus having at least a first sheet feeding unit and a second sheet feeding unit, wherein the printing apparatus is capable of executing a print job for printing an image on a sheet fed from the first sheet feeding unit or the second sheet feeding unit, the printing apparatus comprising:

a setting unit configured to perform a setting to set the first sheet feeding unit and the second sheet feeding unit as a group; and a control unit configured to perform control of sheet feeding, wherein the control unit is configured to perform control of the sheet feeding in such a manner that a sheet is fed from a sheet feeding unit of either one of the first sheet feeding unit and the second sheet feeding unit, in a case where the group is designated in the print job, and to perform control of the sheet feeding to be continued by switching the sheet feeding unit to another one of the first sheet feeding unit and the second sheet feeding unit, in a case where a sheet shortage occurs, and wherein, the control unit is configured to perform control of the sheet feeding in such a manner that a sheet is fed from a designated sheet feeding unit, in a case where the first sheet feeding unit or the second sheet feeding unit is designated in the print job, and to perform control of the sheet feeding in such a manner that switching to another one of the first sheet feeding unit and the second sheet feeding unit is not to be performed, even in a case where a sheet shortage occurs, wherein, in a case where the group is designated in the print job, the control unit determines that a sheet shortage occurs if a remaining sheet amount of a currently used sheet feeding unit becomes a predetermined amount.

2. The printing apparatus according to claim 1, wherein, in a case where the group is designated in the print job, the control unit selects a sheet feeding unit to be used first from between the first sheet feeding unit and the second sheet feeding unit according to a preset order.

3. The printing apparatus according to claim 1, further comprising a display unit configured to display an operation screen, wherein the setting unit performs the setting based on an instruction from a user received via the operation screen.

4. The printing apparatus according to claim 1, further comprising a receiving unit configured to receive, as the print job, a job transmitted from a host computer.

5. The printing apparatus according to claim 1, wherein the print job is a copy job.

6. A method for controlling a printing apparatus having at least a first sheet feeding unit and a second sheet feeding unit, wherein the printing apparatus is capable of executing a print job for printing an image on a sheet fed from the first sheet feeding unit or the second sheet feeding unit, the method comprising:

performing a setting to set the first sheet feeding unit and the second sheet feeding unit as a group; and performing control of sheet feeding, wherein performing control of the sheet feeding includes performing control of the sheet feeding in such a manner that a sheet is fed from a sheet feeding unit of either one of the first sheet feeding unit and the second sheet feeding unit, in a case where the group is designated in the print job, and performing control of the sheet feeding includes performing control of the sheet feeding to be continued by switching the sheet feeding unit to another one of the first sheet feeding unit and the second sheet feeding unit, in a case where a sheet shortage occurs, and wherein, performing control of the sheet feeding includes performing control of the sheet feeding in such a manner that a sheet is fed from a designated sheet feeding unit, in a case where the first sheet feeding unit or the second sheet feeding unit is designated in the print job, and performing control of the sheet feeding includes performing control of the sheet feeding in such a manner that switching to another one of the first sheet feeding unit and the second sheet feeding unit is not to be performed, even in a case where a sheet shortage occurs, wherein, in a case where the group is designated in the print job, performing control of the sheet feeding includes determining that a sheet shortage occurs if a remaining sheet amount of a currently used sheet feeding unit becomes a predetermined amount.

7. The method according to claim 6, wherein, in a case where the group is designated in the print job, performing control of the sheet feeding includes selecting a sheet feeding unit to be used first from between the first sheet feeding unit and the second sheet feeding unit according to a preset order.

8. The method according to claim 6, further comprising displaying an operation screen, wherein performing the setting includes performing the setting based on an instruction from a user received via the operation screen.

9. The method according to claim 6, further comprising receiving, as the print job, a job transmitted from a host computer.

10. The method according to claim 6, wherein the print job is a copy job.

11. A non-transitory computer-readable storage medium storing a program to cause a computer to perform a method for controlling a printing apparatus having at least a first sheet feeding unit and a second sheet feeding unit, wherein the printing apparatus is capable of executing a print job for printing an image on a sheet fed from the first sheet feeding unit or the second sheet feeding unit, the method comprising:

performing a setting to set the first sheet feeding unit and the second sheet feeding unit as a group; and performing control of sheet feeding, wherein performing control of the sheet feeding includes performing control of the sheet feeding in such a manner that a sheet is fed from a sheet feeding unit of either one of the first sheet feeding unit and the second sheet feeding unit, in a case where the group is designated in the print job, and performing control of the sheet feeding includes performing control of the sheet feeding to be continued by switching the sheet feeding unit to another one of the first sheet feeding unit and the second sheet feeding unit, in a case where a sheet shortage occurs, and wherein, performing control of the sheet feeding includes performing control of the sheet feeding in such a manner that a sheet is fed from a designated sheet feeding unit, in a case where the first sheet feeding unit or the second sheet feeding unit is designated in the print job, and performing control of the sheet feeding includes performing control of the sheet feeding in such a manner that switching to another one of the first sheet feeding unit and the second sheet feeding unit is not to be performed, even in a case where a sheet shortage occurs, wherein, in a case where the group is designated in the print job, performing control of the sheet feeding includes determining that a sheet shortage occurs if a remaining sheet amount of a currently used sheet feeding unit becomes a predetermined amount.

12. The non-transitory computer-readable storage medium according to claim 11, wherein, in a case where the group is designated in the print job, performing control of the sheet feeding includes selecting a sheet feeding unit to be used first from between the first sheet feeding unit and the second sheet feeding unit according to a preset order.

13. The non-transitory computer-readable storage medium according to claim 11, the method further comprising displaying an operation screen, wherein performing the setting includes performing the setting based on an instruction from a user received via the operation screen.

14. The non-transitory computer-readable storage medium according to claim 11, the method further comprising receiving, as the print job, a job transmitted from a host computer.

15. The non-transitory computer-readable storage medium according to claim 11, wherein the print job is a copy job.

* * * * *